US008680447B2

(12) United States Patent
Jackson et al.

(10) Patent No.: US 8,680,447 B2
(45) Date of Patent: Mar. 25, 2014

(54) MICROWAVE POPCORN BAG CONSTRUCTION WITH SEAL ARRANGEMENT FOR CONTAINING OIL/FAT, MICROWAVE POPCORN PRODUCT, AND METHODS

(75) Inventors: Eric Craig Jackson, Maple Grove, MN (US); Denise Ellen Hanson, Elk River, MN (US); Charles Thomas Gorman, Mahtomedi, MN (US); Matthew Roth, Chaska, MN (US); Paul John Warosh, Plymouth, MN (US); Lance Schilmoeller, Minnetonka, MN (US); Jody Shands, Plymouth, MN (US)

(73) Assignee: ConAgra Foods RDM. Inc., Omaha, NE (US)

( * ) Notice: Subject to any disclaimer, the term of this patent is extended or adjusted under 35 U.S.C. 154(b) by 261 days.

(21) Appl. No.: 12/947,599

(22) Filed: Nov. 16, 2010

(65) Prior Publication Data

US 2011/0056932 A1 Mar. 10, 2011

Related U.S. Application Data

(63) Continuation of application No. 11/057,307, filed on Feb. 11, 2005, now Pat. No. 7,858,909.

(60) Provisional application No. 60/544,873, filed on Feb. 13, 2004, provisional application No. 60/588,713, filed on Jul. 15, 2004, provisional application No. 60/647,637, filed on Jan. 26, 2005.

(51) Int. Cl.

| | |
|---|---|
| ***H05B 6/80*** | (2006.01) |
| ***A21D 10/02*** | (2006.01) |
| ***B65D 30/14*** | (2006.01) |

(52) U.S. Cl.

USPC ..... 219/727; 219/730; 219/725; 426/107; 426/109; 426/113; 426/115; 426/234; 426/243; 426/106; 383/113; 383/120; 383/109; 383/112; 383/116; 229/903

(58) Field of Classification Search

USPC ..... 219/727, 728, 729, 730; 426/107, 113, 426/234, 110; 428/34.3; 383/97, 105, 106, 383/107, 108, 109, 110, 111, 112, 113, 114, 383/115, 116, 117, 118, 119, 120; 206/219

See application file for complete search history.

(56) References Cited

U.S. PATENT DOCUMENTS 3,207,420 A * 9/1965 Navarrete-Kindelan ..... 383/38
4,450,180 A 5/1984 Watkins (Continued)

FOREIGN PATENT DOCUMENTS

MX 294908 1/2012
WO WO 03/077675 A1 9/2003

OTHER PUBLICATIONS

International Search Report and Written Opinion mailed Dec. 5, 2005, in Application Serial No. PCT/US2005/004249.

(Continued)

*Primary Examiner* — Ellen S Raudenbush
*Assistant Examiner* — Anthony J Frost
(74) *Attorney, Agent, or Firm* — Advent, LLP; Ryan T. Grace

(57) ABSTRACT

Microwaveable popcorn arrangements are provided, the arrangement being a bag having a popcorn charge of popcorn kernels and oil/fat component therein. The arrangements include folded bags having preferred, internal, seal and/or adhesive field configurations. The preferred configurations inhibit the undesired flow of oil/fat from the popcorn charge. Microwave popcorn products and methods of preparation and use, are provided.

20 Claims, 14 Drawing Sheets

(56) References Cited

U.S. PATENT DOCUMENTS

| | | | | | |
|---|---|---|---|---|---|
| 4,548,826 | A | | 10/1985 | Watkins | |
| 4,571,337 | A | | 2/1986 | Cage et al. | |
| 4,691,374 | A | * | 9/1987 | Watkins et al. | 383/104 |
| 4,735,513 | A | | 4/1988 | Watkins et al. | |
| 4,878,765 | A | | 11/1989 | Watkins et al. | |
| 5,044,777 | A | | 9/1991 | Watkins et al. | |
| 5,075,119 | A | | 12/1991 | Mendenhall | |
| 5,081,330 | A | | 1/1992 | Brandberg et al. | |
| 5,171,594 | A | * | 12/1992 | Babbitt | 426/107 |
| 5,195,829 | A | | 3/1993 | Watkins et al. | |
| 5,294,765 | A | | 3/1994 | Archibald et al. | |
| 5,302,790 | A | | 4/1994 | Turpin | |
| 5,317,118 | A | | 5/1994 | Brandberg et al. | |
| 5,326,576 | A | | 7/1994 | Zuege | |
| 5,357,086 | A | | 10/1994 | Turpin et al. | |
| 5,405,663 | A | | 4/1995 | Archibald et al. | |
| 5,460,839 | A | | 10/1995 | Archibald | |
| 5,461,216 | A | * | 10/1995 | McDonald | 219/727 |
| 5,474,383 | A | * | 12/1995 | Zuege et al. | 383/121 |
| 5,650,084 | A | * | 7/1997 | Bley | 219/727 |
| 5,690,853 | A | | 11/1997 | Jackson et al. | |
| 5,753,895 | A | | 5/1998 | Olson et al. | |
| 5,773,801 | A | | 6/1998 | Blamer et al. | |
| 5,928,554 | A | * | 7/1999 | Olson et al. | 219/727 |
| 5,994,685 | A | * | 11/1999 | Jackson et al. | 219/727 |
| 6,005,234 | A | | 12/1999 | Moseley et al. | |
| 6,046,443 | A | | 4/2000 | Ackerman et al. | |
| 6,049,072 | A | | 4/2000 | Olson et al. | |
| 6,060,095 | A | | 5/2000 | Scrimager | |
| 6,060,096 | A | | 5/2000 | Hanson et al. | |
| 6,077,551 | A | | 6/2000 | Scrimager | |
| 6,100,513 | A | | 8/2000 | Jackson et al. | |
| 6,372,361 | B1 | | 4/2002 | Mackewicz et al. | |
| 6,396,036 | B1 | | 5/2002 | Hanson | |
| 6,746,700 | B1 | | 6/2004 | Landon | 426/93 |
| 7,858,909 | B2 | | 12/2010 | Jackson et al. | |
| 2002/0182291 | A1 | | 12/2002 | Renini et al. | 426/107 |
| 2004/0197441 | A1 | | 10/2004 | Tech | 426/107 |
| 2008/0268106 | A1 | | 10/2008 | Jackson et al. | |

OTHER PUBLICATIONS

International Preliminary Report on Patentability mailed Aug. 24, 2006, in Application Serial No. PCT/US2005/004249.

Canadian Official Action mailed Aug. 8, 2011, in Application Serial No. 2,555,237.

Japanese Official Action mailed Sep. 20, 2011, in Application Serial No. 2006-553233.

U.S. Official Action mailed Oct. 18, 2011, in U.S. Appl. No. 11/788,364.

European Official Action mailed Mar. 7, 2012, in Application Serial No. 05 713 285.4-1261.

* cited by examiner

MICROWAVE POPCORN BAG CONSTRUCTION WITH SEAL ARRANGEMENT FOR CONTAINING OIL/FAT, MICROWAVE POPCORN PRODUCT, AND METHODS

This application is a continuation of U.S. application Ser. No. 11/057,307 filed on Feb. 11, 2005, which claims the benefit under 35 U.S.C. 119(e) to U.S. Provisional Application No. 60/544,873 filed Feb. 13, 2004, to U.S. Provisional Application No. 60/588,713 filed Jul. 15, 2004, and to U.S. Provisional Application No. 60/647,637 filed Jan. 26, 2005. The complete disclosures of the aforementioned applications are incorporated herein by reference.

FIELD OF THE DISCLOSURE

The present disclosure relates to microwaveable packaging for food, in particular, for popping microwaveable popcorn. The principles herein relate to preferred seal arrangements for a package with an internally received popcorn charge or a package configured to internally receive a popcorn charge.

BACKGROUND

A wide variety of microwaveable food products are presently known. Those of particular concern herein are those which are used to pop microwaveable popcorn. In general, the product is a package which includes an unpopped popcorn charge. In use, the package including the unpopped popcorn charge is positioned appropriately in a microwave oven, and is exposed to microwave energy. During the microwave process, the popcorn is popped. These products are well known to consumers.

Particular arrangements to which the present invention relates are those in which the packages are flexible bags or pouches that expand during the popping process. Flexible bag arrangements are described, for example, in U.S. Pat. Nos. 4,548,826; 4,691,374; 5,081,330; 5,044,777; 5,195,829; 5,302,790; and, 5,650,084. The disclosures of these identified seven patents are each incorporated herein by reference.

Referring to U.S. Pat. No. 5,044,777, certain characteristics of conventional microwaveable popcorn packaging are apparent. First, the bags are generally provided in a configuration wherein side gussets are used to separate the internal volume of the bag into first and second "tubes." When the bag is filled, generally the popcorn charge is placed in one of the two "tubes" and is substantially retained therein, prior to popping.

Also, in generally, the popcorn charge is positioned primarily in a center portion (typically about a center one-third) of the package, relative to its length. In many arrangements, during storage the bag is folded into a "tri-fold" configuration. This is apparent from the drawings and descriptions in U.S. Pat. Nos. 5,044,777 and 5,195,829, and is specifically illustrated in FIG. 5 of U.S. Pat. No. 4,548,826, FIGS. 3 and 14 of U.S. Pat. No. 4,691,374, and in U.S. Pat. No. 5,650,084 at FIGS. 1 and 4.

In some instances, it has been found that positioning the popcorn charge substantially only in one of the two tubes, especially in association with a microwave interactive material or susceptor positioned in close proximity, leads to preferred characteristics of popping. This is referenced generally in the U.S. patents identified above, and specifically in connection with U.S. Pat. Nos. 4,548,826 and 4,691,374.

Herein, when it is said that the popcorn charge is "substantially only" in a location, it is meant that preferably at least 80%, more preferably at least 95 wt-% most preferably essentially all (i.e., at least 99% by weight) of the charge (popcorn, fat, flavor, etc.), is at the stated location.

The present invention relates to improvements in microwave popcorn packaging and products.

SUMMARY OF THE INVENTION

According to the present disclosure a microwaveable popcorn arrangement is provided. The arrangement includes a folded bag, defining a bag interior and including first and second opposite face panels joined by first and second opposite, inwardly directed, side gussets. Each side gusset preferably comprises two panel sections, a first one adjacent the first face panel and a second one adjacent the second face panel. The bag is folded to define a portion of the interior with side edges defined by first and second, opposite, outwardly directed gusset folds, each formed at a juncture or interface between the first face panel and a first panel section of an inwardly directed side gusset.

The present disclosure includes various techniques for managing oil/fat location and migration, within the folded bag interior. Various embodiments are provided as examples.

The various embodiments provide examples that demonstrate, among other things, the following general techniques:

1. Utilization of seal arrangements to inhibit oil/fat migration.

2. Utilization of a surface treatment applied to the paper to inhibit undesirable oil/fat migration.

Various principles of the described techniques can be implemented, to advantage. The described embodiments exemplify various applications of the techniques, independently or together.

In typical use, a popcorn charge including unpopped popcorn kernels and an oil/fat component is positioned within the interior of the bag in contact with a portion of the first face panel at a selected location. Although alternatives are possible, typically the folded bag is made (folded) from a flexible, typically two-ply bag blank, in many instances having a microwave interactive construction therein.

Some specific examples, as well as methods of assembly and use, are provided.

The techniques described can be applied to a variety of materials as the bag construction, and to various edible contents of the bag. Some examples are described, including using non-fluorocarbon treated paper for the bag construction and using an oil/fat having a preferred, low trans-fat content.

In some of the drawings, in some instances, relative component thicknesses may be shown exaggerated for clarity.

DETAILED DESCRIPTION

I. Problems with Some Conventional Systems.

The present disclosure relates to improvements in microwave packaging constructions, such as those described in the incorporated references. Such arrangements generally involve a collapsed bag, having a microwave interactive sheet or susceptor operably positioned therein, and with a popcorn charge positioned in a covering relation or thermoconductive relation to the microwave interactive construction. For many conventional arrangements, the bag is generally folded into a tri-fold configuration during storage and prior to use. The tri-fold is typically positioned in a moisture barrier overwrap to extend shelf life for the contents.

Such arrangements as those depicted in the references cited above generally involve folded paper constructions in which creases or folds are present at opposite side edges of the paper and where side gussets are attached to (or are integral with) two opposite face panels. One pair of opposite edge folds is generally located on opposite sides of a first face panel in one tube of the bag, with a second pair of opposite edge folds at opposite sides of a second face panel in an opposite, second tube. During initial loading of a popcorn charge into the bag, the popcorn charge is generally placed in one of the two tubes, against a portion of a panel between the creased or folded side edges.

During production, storage, distribution and handling, if the oil/fat contains any liquid or liquefied component, the oil/fat may begin to undesirably migrate within the bag and wick from the bag. Further, during the microwave popping operation, the oil/fat totally melts and flows.

Flow of liquid oil/fat within the bag can result in leakage or leaking problems. For example, the oil/fat can begin to wick through the bag, especially at locations where fractures in the paper may be present. Also, the oil/fat can migrate to seams or seals, for example, to a seam near an end of the package, and leak through the seam.

Creasing of paper generally results in microfracture of the paper integrity at the edge of creasing. With some arrangements, if the popcorn charge is allowed to come into direct contact with a creased location, several problems can occur. First, during production, distribution and storage, depending on the content of the microwave popcorn charge, undesirable levels of leakage or wicking of oil/fat material through the paper material at the creased edges can occur. Secondly, during microwave popping, undesirable levels of leakage or wicking of oil/fat can occur along this same creased location.

The present disclosure relates to microwave popcorn packaging arrangements which are configured so that leakage or wicking is managed in unique ways.

II. The Arrangement of FIGS. 1-5.

Figure 1:
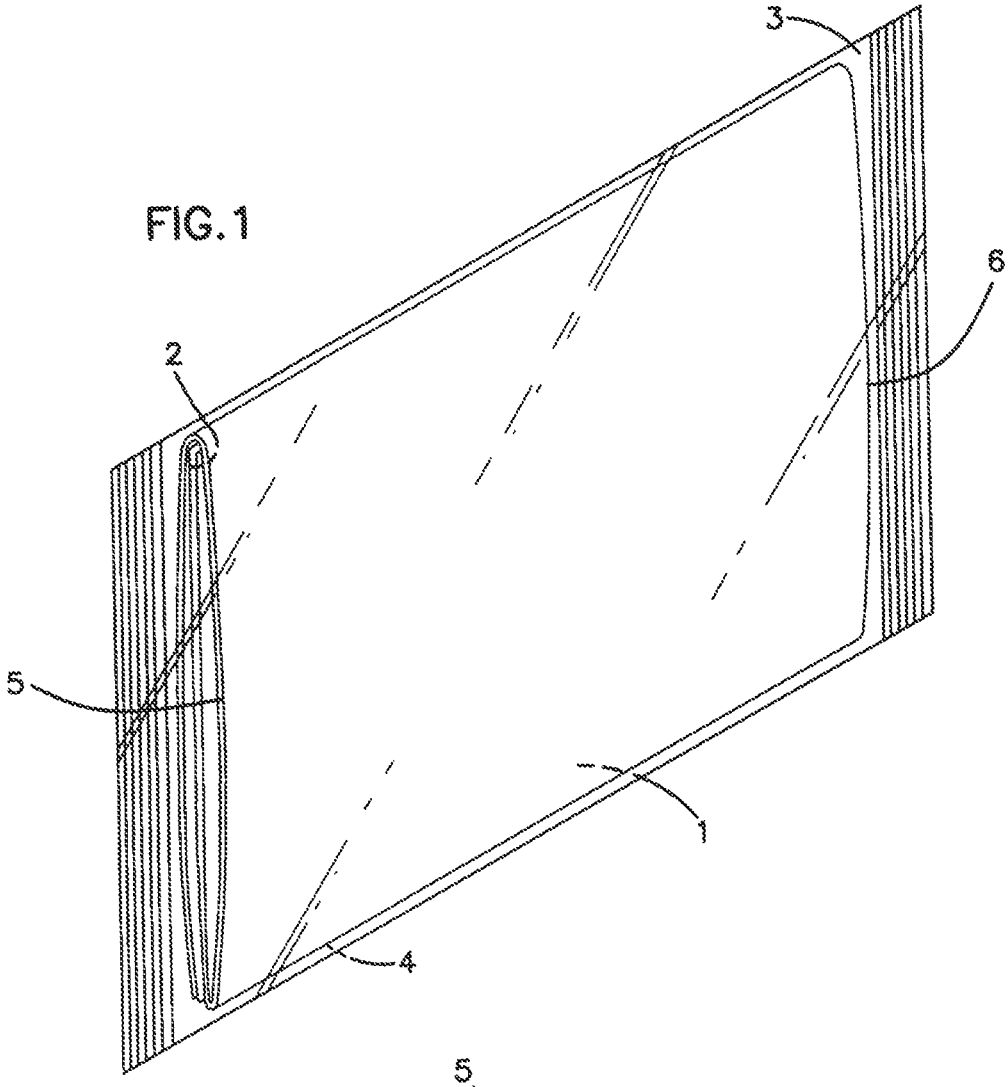
FIG. 1 is a front perspective view of a bag package arrangement having a microwaveable popcorn charge therein; the arrangement of FIG. 1 being depicted in a storage overwrap and oriented standing on an edge.

The reference numeral 1, FIG. 1, depicts a microwaveable popcorn bag according to the present disclosure. In FIG. 1, the popcorn bag 1 is depicted in a conventional "tri-fold" configuration 2, for storage. In FIG. 1, the tri-fold 2 is sealed within a storage overwrap 3. A useable storage overwrap 3 would comprise a 90-140 gauge, biaxially oriented polypropylene, although other materials can be used. The overwrap 3 is discarded when the popcorn bag 1 is removed from storage, in preparation for use.

In FIG. 1, the bag 1 is shown stood up on edge 4, as it could be when stored in a shipping box. Of course, it can be shipped stored on a side instead of standing on an edge.

Still referring to FIG. 1, the bag 1 has two opposite sides 5, 6, each side 5, 6, as discussed in detail below, comprising two side gusset outside edges, along which creases are located.

As indicated, the arrangement depicted in FIG. 1 is a "tri-fold." The invention is described and depicted in connection with an arrangement folded, or intended to be folded, as a tri-fold 2. It will be apparent, however, that the techniques according to the present disclosure can be utilized in other folded arrangements, i.e., even when the arrangements are not folded as tri-folds 2.

Figure 2:
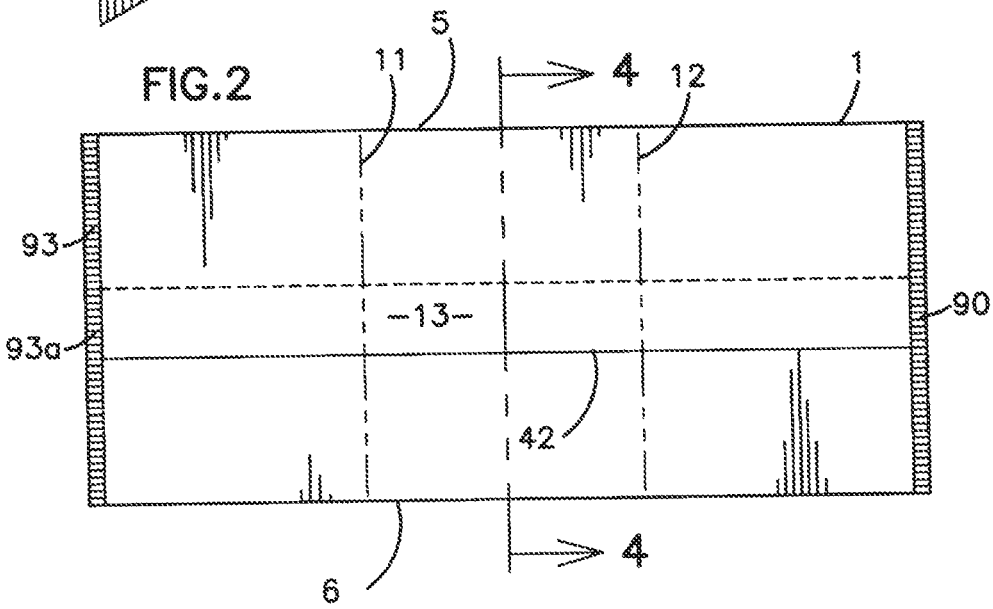
FIG. 2 is a schematic top plan view of the bag according to FIG. 1, depicted unwrapped and unfolded as it would be when positioned in a microwave oven for cooking.

In FIG. 2, a top plan view, bag 1 is schematically shown in an unfolded configuration oriented much as it would be when positioned in a microwave oven for popping of an internally received popcorn charge, but before expansion. In FIG. 2, lines 11 and 12 indicate fold lines which define a central region 13 and which formed the folds to make the trifold 2, FIG. 1. In central region 13, the unpopped popcorn charge will generally be positioned in an orientation against, and when oriented as shown in FIG. 2 above, a portion of the bag 1 in which a microwave interactive construction is preferably positioned. Herein, in this context, the term "microwave interactive" is meant to refer to a material which absorbs energy and becomes hot, upon exposure to microwave energy in a microwave oven.

During the popping operation, moisture inside the popcorn kernels absorbs microwave energy, generating sufficient steam and heat for popping of the kernels and expansion of bag 1. In addition, the microwave interactive material absorbs microwave energy and dissipates heat to the popcorn charge. In preferred constructions, the microwave interactive material occupies at least central region 13 (internally) and is in greater thermoconductive contact with a portion of that region than any other portions of an interior of popcorn bag 1. That is, most of the microwave interactive material (by area or weight) is positioned in thermoconductive contact with a region of the bag interior whereat the microwave interactive will be covered by the popping charge, when the bag 1 is positioned in a microwave oven for use. This is preferred, since it leads to a preferred and efficient utilization of microwave interactive material and also due to preferred heat transfer or heat retention characteristics in connection with the popcorn popping process.

Figure 4:
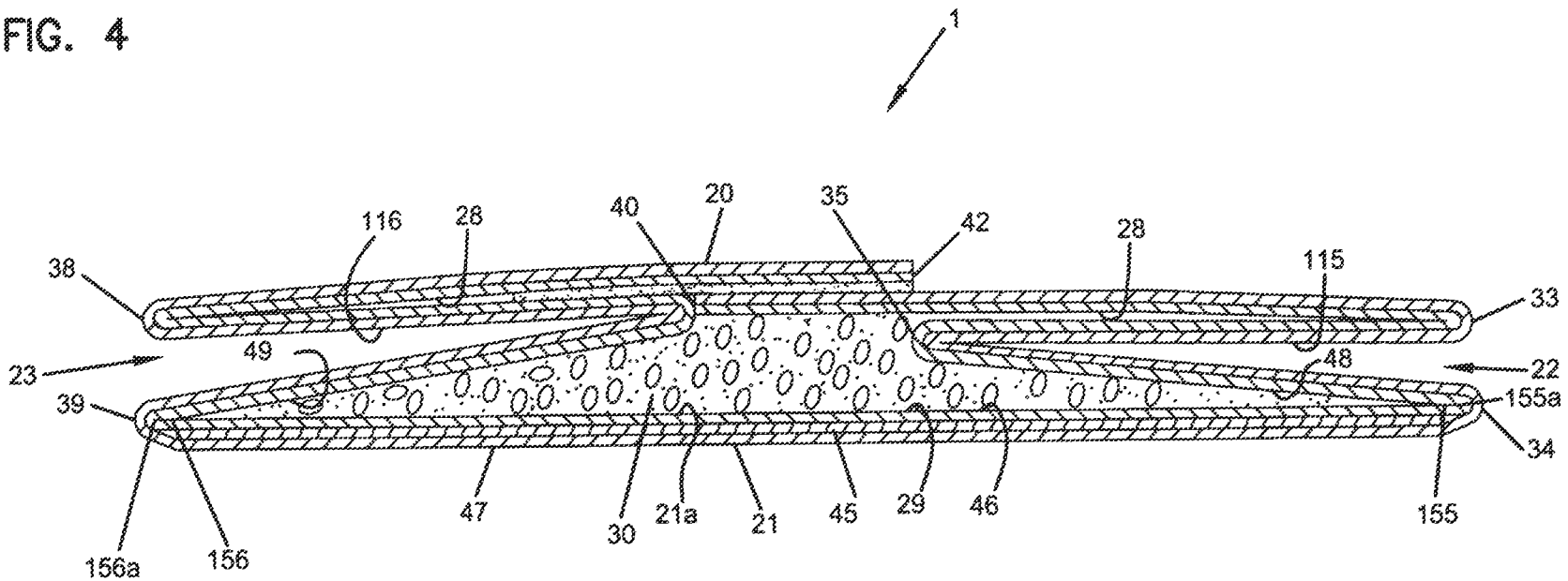
FIG. 4 is an enlarged cross-sectional view taken generally along line 4-4 of FIG. 2.

Attention is now directed to FIG. 4, a cross-section taken generally along line 4-4 of FIG. 2. From a review of FIG. 4, it will be understood that the bag generally comprises a construction defining first and second opposite face panels 21, 20 joined by first and second, opposite, inwardly directed side gussets 22, 23. By "inwardly directed" in this context it is meant that, in the cross-section of FIG. 4, gussets 22, 23 point or extend toward one another. In the construction of FIG. 4, the bag 1 has only one inwardly directed gusset at each side.

The gussets 22 and 23 generally separate popcorn bag 1 into first and second expandable tubes 28 and 29. A popcorn charge 30 is substantially positioned and substantially retained within one of the tubes, in this instance tube 29. The other tube, tube 28, prior to popping, is generally collapsed. Indeed, in preferred arrangements, tube 28 is sealed closed by temporary heat seals prior to the popping operation.

Still referring to FIG. 4, side gusset 22 generally comprises: outwardly directed edge creases or folds 33 and 34, fold 34 being adjacent face panel 21 and fold 33 being adjacent face panel 20; and, inwardly directed central fold 35. Similarly, gusset 23 comprises: outwardly directed edge creases or folds 38 and 39; and, inwardly directed central fold 40; fold 39 being adjacent face panel 21 and fold 38 being adjacent face panel 20. Although alternatives are possible, bag 1, for the arrangement shown in FIG. 4, is folded from a two-ply sheet of material, and panel 20 includes central longitudinal seam 42 therein. Such folds as folds 33, 34, 35, 38, 39 and 40 are known for flexible microwave packaging, for example as shown in U.S. Pat. Nos. 5,044,777; 5,195,829; and, 5,650,084.

Underneath popcorn charge 30, bag 1 includes microwave interactive construction or susceptor 45. The microwave interactive construction or susceptor 45 may be of a conventional design. A typical microwave interactive construction comprises a flexible, metallized polyester sheet. In certain arrangements, such as the one shown in FIG. 4, the susceptor 45 is positioned between layers or plies 46, 47 from which the flexible bag 1 is folded. Even with the susceptor 45 positioned between plies 46, 47, the bag 1 is referenced as two-ply. In the arrangement shown, the susceptor 45 only occupies a portion of the area between the plies 46, 47.

Still referring to FIG. 4, the gusset 23 includes a panel section 49 adjacent to, and integral with, face panel 21. Additionally, the gusset 22 includes panel section 48 adjacent to, and integral with, face panel 21. Panel 21 includes region 21*a* which defines an unpopped popcorn charge retention surface. This is because the unpopped popcorn charge 30 is generally positioned in contact with, and generally sitting on, region 21*a* when the bag 1 is positioned in a microwave oven.

Figure 3:
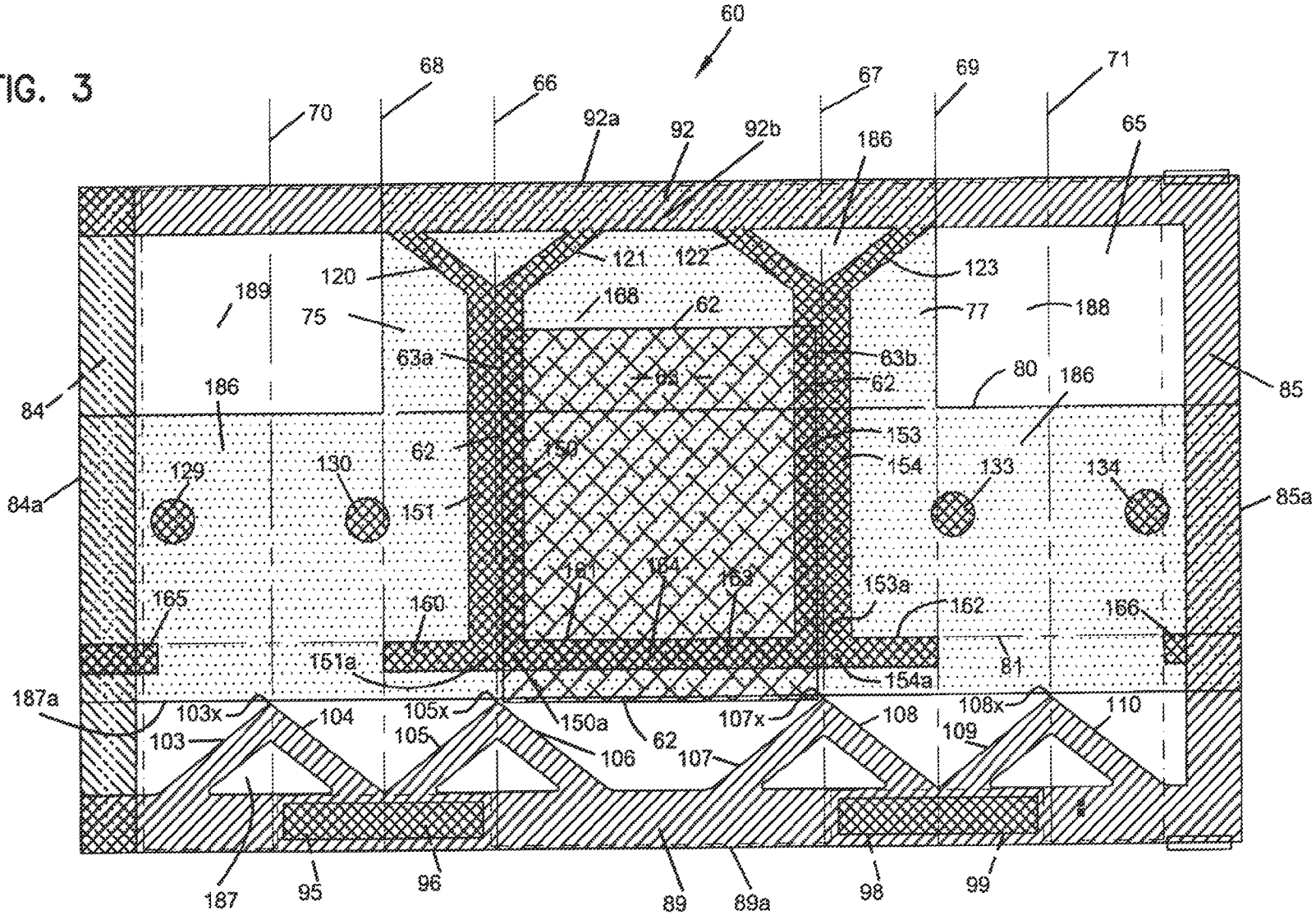
FIG. 3 is an enlarged top plan view of a sheet of flexible material from which a bag, such as that shown in FIGS. 1 and 2 can be folded; the arrangement of FIG. 3 including markings indicating where adhesive material is preferably positioned in the construction.

Attention is now directed to FIG. 3. In FIG. 3, a top plan view of a bag blank, panel or sheet 60 from which an arrangement according to FIGS. 1, 2 and 4 and can be folded, is shown. The view in FIG. 3 is of a side 65 of sheet 60 which forms the interior surface of the assembled bag 1, FIG. 1. The side opposite the side viewable in FIG. 3 will form the exterior surface of the bag 1. Of course, a mirror image to the view of FIG. 3 could also be used as the interior surface.

Still referring to FIG. 3, line segment 62 defines a region 63 within which, for preferred embodiments, most of the microwave interactive material, such as susceptor 45, would be associated. In addition, the popcorn charge 30 will eventually be positioned over (or against) region 63. The microwave interactive construction, for example susceptor 45, FIG. 4, may be positioned on an interior of the arrangement, an exterior, or between plies 46, 47. In general, for preferred embodiments, susceptor 45 is positioned between plies 46, 47 of the blank 60.

Still referring to FIG. 3, line 66 generally indicates where fold 34, FIG. 4, will be formed, and line 67 generally indicates where fold 39, FIG. 4, will be formed. Folds 34, 39 are generally outwardly directed folds or creases in opposite side gussets 22, 23 adjacent face 21. Region 21*a*, for positioning of a popcorn charge thereon, in use, extends between the folds 34, 39. Line 68 corresponds with fold 35 (FIG. 4); line 69 with fold 40 (FIG. 4); line 70 with fold 33 (FIG. 4); and, line 71 with fold 38 (FIG. 4). Thus, region 75, between fold lines 68 and 66, will generally define gusset panel section 48, FIG. 4, and region 77 between fold lines 67 and 69 will generally define gusset panel section 49, FIG. 4.

In general, the tri-fold 2 is eventually formed by folding the overall bag 1 such that it folds along lines 80 and 81. It will be understood that this latter folding would generally be after the bag construction, FIG. 2, has been otherwise assembled. Line 81 will form edge 4, FIG. 1. Referring to FIGS. 2 and 3, line 80 will form fold 11 and line 81 will form fold 12.

Referring to FIG. 3, sealant region 84, along edge 84*a* positioned on opposite side of panel 60 from side 65, is used to engage region 85 along edge 85*a*, during folding, to form the longitudinal seam or seal 42, FIG. 4. It will also be apparent that, during folding, various portions of field 89 along edge 89*a* on side 65 will align with one another to form various portions of end seal 90, FIG. 2; and, various portions of field 92, along edge 92*a* on side 65, FIG. 3, will align with one another to form end seal 93, FIG. 2. In general, field 92 will form a top edge of the completed bag, through which popped popcorn is removed, after popping.

Referring to FIG. 2, in region 93*a* in seam 92 (FIG. 3), a thinner or weaker portion of the adhesive may sometimes be provided, to provide opening release and vent, during operation.

Sealant fields 95 and 96, in this instance shown as rectangular and positioned on the opposite side of the panel 60, FIG. 3, will align with one another, when folding around fold line 68 is conducted, to help secure panel 60 in a preferred configuration, along end 90, FIG. 2, after folding. This is analogous to the arrangement of U.S. Pat. No. 5,195,829, FIG. 1a. Similarly, sealant fields 98 and 99, on underside of panel 60, FIG. 3, are aligned with one another when the panels are folded around fold line 69, also to provide a secure and preferred end configuration to end 90, FIG. 2.

The sealing of the various sealant fields, described above and below, is typically done with the application of heat and pressure.

Attention is now directed toward sealant fields 103, 104, 105, 106, 107, 108, 109 and 110. Analogous fields were shown in U.S. Pat. No. 5,195,829, FIG. 1. During folding, portions of fields 103-110 align with one another to retain selected portions of the panel adhered to one another (typically after application of pressure and heat) to provide for preferred configuration during expansion. In particular, field 103 engages field 104; field 105 engages field 106; field 108 engages field 107; and, field 110 engages field 109, during folding. Engagement between fields 105 and 106, and also between fields 108 and 107, tends to retain selected portions of panels 48 and 49 against panel 21, FIG. 4, in regions where the popcorn charge is not located in the collapsed fold or tri-fold 2 (FIG. 1). Sealant field 103 folded and sealed against field 104, and field 110 folded against field 109, help retain panels 115 and 116 seal against panel 20, FIG. 4, in the collapsed tri-fold. This helps ensure that the popcorn charge 30 is retained where desired in the arrangement. Fields 103-110 are sometimes called diagonal fields, since they extend at an acute angle relative to fold lines 66-71. The resulting seals are sometimes analogously termed "diagonal gusset seals."

Herein, the adhesive shape in the blank of FIG. 3, formed by fields 103 and 104 together, is sometimes referred to as a chevron shape. Similarly fields 105, 106 form, collectively, a chevron shape, as well as fields 107, 108 together, and fields 109 and 110 together. Of course, in the final folded products, FIG. 2, each chevron shape has been folded in half, through a centerline directed through its apex.

Referring again to FIG. 3, attention is now directed to sealant fields 120, 121, 122, 123. When the arrangement is folded about fold line 66, sealant field 120 aligns with and is sealed to, sealant field 121; and, when the arrangement is folded about fold line 67, sealant field 123 aligns with and is sealed to sealant field 122. The engagement between fields 120, 121 further ensures that the panel 48 will be sealed against the panel 21 (FIG. 4); and, the engagement between fields 123 and 122 will further ensure that panel 49 is sealed against panel 21, at regions whereat the popcorn charge 30 is not positioned. This is similar to the utilization of fields in FIG. 1, of U.S. Pat. No. 5,195,829.

Fields 120, 121, together, generally have a chevron shape, as do fields 122 and 123, together. In each instance, the chevron shape would be folded in half around a fold line directed through the apex of each chevron. Herein fields 120-123 will sometimes be referred to as diagonal fields, and the seals formed therefrom as diagonal seals, because they extend at an acute angle to fold lines 66, 67.

The shape and direction of fields 105, 106, 107, 108, 120, 121, 122 and 123 helps ensure that central section 63 will remain relatively flat, as the bag 1 expands in use under the steam from popping popcorn.

Attention is now directed to sealant fields 129, 130, 133 and 134. In the preferred embodiment shown, these are also used to ensure that panels 115 and 116 are sealed against panel 20, FIG. 4, so that the popcorn charge 30 is substantially retained in tube 29 (FIG. 4), and does not expand or spread substantially into tube 28 until desired during heating. In particular, fields 129 and 130 are oriented to engage one another when the arrangement is folded about fold line 70; and, fields 133 and 134 are oriented to engage one another when the arrangement is folded about fold line 71.

Seals of the type associated with fields 129, 130, 133, 134 have been used in previous constructions. For example, see U.S. Pat. No. 5,044,777, FIG. 1.

Typically, sealing results from application of pressure, after folding, to the region where the sealant is located. It is noted that for the various seals discussed, sealant is positioned on both adjoining paper surfaces. This is convenient. However if sealant is only positioned on one side, and the two sides are folded together with follow-up application of appropriate pressure, a seal can be formed. It is noted that cold sealing approaches may be possible, but typically adhesives are used which are sealed with both heat and pressure.

This disclosure also provides optional provisions of arrangements that inhibit the popcorn charge, prior to popping, from undesirable levels of direct contact with certain locations in the bag 1. An example of this are arrangements that inhibit undesirable levels of oil/fat contact with creases at fold lines 66, 67, FIG. 3; i.e., folds 34, 39, FIG. 4. It is noted that certain other figures, discussed below, include alternate applications of related principles and also to additional features that help provide desired oil/fat location of flow within the bag 1, during storage, handling and use.

Herein, attention is first directed to the features of FIG. 3, relating to control of oil/fat flow location. For fold line 66, attention is directed to sealant fields 150, 151; and, for fold line 67, attention is directed to sealant fields 153, 154. It is noted that for the arrangement shown, fields 150, 151 are integral with one another, and meet at fold line 66, and that similarly fields 153, 154 are integral with one another and meet at fold line 67. This is preferred but is not required. (Alternately stated, fields 150, 151 are parts of a single field with fold line 66 therethrough, and fields 153, 154 are parts of a single field with fold line 67 therethrough.)

When the fold around fold line 66 is made, sealant field 151 will overlap sealant field 150, with seal 155, FIG. 4, resulting. Similarly, when folding around fold line 67 occurs, field 154 will overlap field 153, with seal 156, FIG. 4, resulting.

Although alternatives are possible, it is noted that for the example shown, when folding around fold line 66 is made to generate seal 155, at least a portion of seal 155: (a) is located at least 2 inches (50.8 mm) from edge 92*a*; (b) is spaced from sealant field 92 a distance of at least 1 inch (25.4 mm); (c) is not part of a diagonal seal or chevron shape; (d) is positioned at least 2 inches (50.8 mm) from edge 89*a*; and (e) is positioned at least 1 inch (25.4 mm) from end sealant field 89.

When it is said that at least a portion of the seal 155 is spaced as characterized, it is not meant that the entire field is necessary so spaced, unless specifically stated. Rather, it is meant that at least a portion of the seal is positioned where indicated, whereas other portions may be differently spaced.

Seal 156 is analogous to seal 155, and preferably has analogous features.

When the popcorn charge is positioned in region 63, the popcorn charge including components such as oil/fat therein, are inhibited from flow to, i.e., from reaching, creases or fold lines 66, 67 (i.e., creases at 34, 39, FIG. 4) due to the presence of the seals 155, 156. In part, seals 155, 156, FIG. 4, operate to inhibit oil/fat flow in contact with folds around line 66, 67 respectively (FIG. 3) by tacking gusset folds 34, 39, FIG. 4, closed adjacent the fold lines 66, 67 (FIG. 3).

The seals 155, 156 can be configured to release upon exposure to steam and heat during a microwave popcorn popping operation, if desired.

Preferably, at least a portion of seals 155, 156 is positioned in overlap with region 63, i.e., an overlap in the central portion of region 21*a* with susceptor 45, FIG. 4, underneath.

Seals such as seals 155, 156 will generally be characterized as "opposite gusset seals positioned to extend along opposite sides of central region 63 in overlap with susceptor 45, in the opposite gusset folds 34, 39 integral with panel 21" or by similar terminology. Although diagonal seals formed between fields 120, 121; 122, 123; 105, 106; and 107, 108 are also gusset seals in the opposite gusset folds 34, 39 integral with panel 21, they are not positioned "in overlap with susceptor 45," i.e., in overlap with region 63. Thus, they are distinguished by seals 155, 156 at least when defined in the manner of this paragraph.

Herein, seals of the type shown at seals 155, 156, are also sometimes referred to herein as "insulating seals" with respect to an associated (typically adjacent) crease or fold. This is because these seals insulate the associated crease or fold, during storage of bag 1, with respect to flow of material from within the popcorn charge, to direct contact with the associated crease or fold. Thus, seal 155 is an insulating sealant field with respect to fold or crease along line 66 to form crease or fold 34 (FIG. 4), and field 156 is an insulating sealant field with respect to fold or crease line 67; i.e., fold or crease 39 (FIG. 4).

Referring to FIG. 3, it is noted that for formation of insulating seals 155, 156, preferably fields 150, 151, 153 and 154 are continuous, i.e. without gaps therein, in extension along the fold lines 66, 67 respectively, defining opposite edges 63*a*, 63*b* of central region 63. This continuous nature to the sealant fields and in the resulting seals 155, 156 (FIG. 4), sometimes called "full seals" since they are continuous, helps inhibit undesirable wicking or leaking at the creases caused in fold lines 66, 67. It is noted that some beneficial results can be obtained even if the insulating fields were not continuous. Herein below, in connection with FIG. 7, for example, an arrangement with spaced seals that provide for advantage without full insulation is provided.

When used to form gusset fold insulating seals of the type shown in FIG. 3, a preferred total length to the fields 150, 151 and 153, 154 is preferably at least 20% (usually at least 25%, typically at least 30%) of the entire length of the package (or length of the fold lines 66, 67) between ends 90, 93 (FIG. 2). More preferably they are each at least 45% of the length of the bag 1, FIG. 2, or fold lines 66, 67, FIG. 3; most preferably and typically the length of the fields 150, 151, 153, 154 in the longitudinal direction of extension of the package, is 50%-70% of the total length of bag 1, or fold lines 66, 67, (FIG. 3), between ends 90, 93. While alternatives are possible, these will be preferred seals, when the seals are insulating seals. In FIG. 3, the portions of blank 60 that form ends 90, 93, FIG. 2, are edges 89*a* and 92*a*, respectively.

Most preferably, the seals 155, 156 are at least positioned and configured to extend continuously between the folds 80, 81 of the trifold (corresponding to folds 11, 12 respectively, FIG. 2). It can be seen from FIG. 3, that the sealant fields that form seals 155, 156 extend even further than this.

Most preferably, the fields 150, 151, 153, 154, FIG. 3, terminate with ends spaced from associated edges 92*a*, 89*a* of the package blank 60, which will correspond to ends 93, 90 of the folded bag 1, FIG. 2. Preferably, the spacing is at least 7 cm or 70 mm (for example about 8-9.5 cm or 80-95 mm) from edge 89*a*; and, at least 7 cm or 70 mm from edge 92*a*. The spacing will not necessarily be the same from each edge 89*a*, 92*a*. Indeed, in the embodiment shown, it is not. (It is noted that with respect to this observation, fields 120-123 and 92 are not to be considered as part of the gusset fold insulating seals, although alternate definitions are possible.)

Referring to FIG. 3, attention is now directed to sealant fields 160, 161, 162, 163, 164, 165 and 166. During folding around line 66, field 160 will overlap field 161, with formation of a seal therebetween. During folding around line 67, field 162 will overlap field 163, with formation of a seal therebetween. Region 164 will seal to regions 165, 166, when folding around fold lines 68, 70 and 69, 71. It is noted that region 151*a* of sealant field 160 is also part of field 151. Similarly, region 150*a* in region 161 is also part of region 150. Further, region 153*a* of field 163 is part of field 153; and region 154*a* of region 162 is part of region 154.

The net result will be formation of a region in a folded bag 1 of a transverse containment seal extending between gusset fold insulating seals 155, 156, FIG. 4. This sealant field will help contain oil/fat within the popcorn 30, at a location between seals 155, 156, FIG. 4, and also at a location over center 63, and away from seal 90, FIG. 2, during production, distribution, storage and initial use. The transverse containment seal is preferably continuous in extension between insulating seals 155, 156, although alternatives are possible. The transverse containment seal is optional.

It is noted, that as a result of seals 155, 156 (and the presence of optional transverse sealant field resulting from overlap of fields 160, 161, 162, 163, 164, 165 and 166) a three-sided insulated seal pouch against panel 60 around a center 63 (FIG. 3) of surface portion 21*a* (FIG. 4) is formed, in which a popcorn charge is stored, during use. It is also noted that along region 168, FIG. 3, no analogously operating product transverse seal is positioned, in the embodiment shown. A second product transverse seal could be located across region 168, however, if desired, to form a four-sided seal pouch. (In this latter discussion, sealant fields 121, 122 and 92 are not viewed as a transverse sealant fields, although under some alternate definitions they could be.)

Referring to FIG. 3, it is noted that fields 160, 161, 162, 163, 164, 165 and 166 are each located on an opposite side of fold line 81 from a portion of region 63 whereat product will be positioned, during storage. If a transverse seal from regions 160-166 is used, this will be a preferred location because this location is convenient for typical form, fill and seal operations.

Still referring to FIG. 3, it is noted that not all of the susceptor within region 63 that is defined by border 62 is located underneath a portion of inner panel 46 that is positioned and contained within borders defined by the transverse seal and the insulating seals. This accommodates variances in roll stock lamination and folding.

The seals formed by fields 160, 161, 162, 163, 164, 165 and 166 (if used) will preferably be made releasable seals, so that heat, steam and package expansion, during a popping operation, will open these seals to allow proper expansion of the bag. (In contrast, typically seals formed by fields such as 103-110 and 120-123 are typically not opened or released during expansion of the popcorn bag during popping.)

Figure 16:
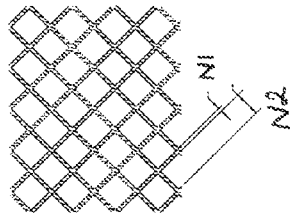
FIG. 16 is a further enlarged top plan view of an adhesive pattern of FIG. 15.
Figure 15:
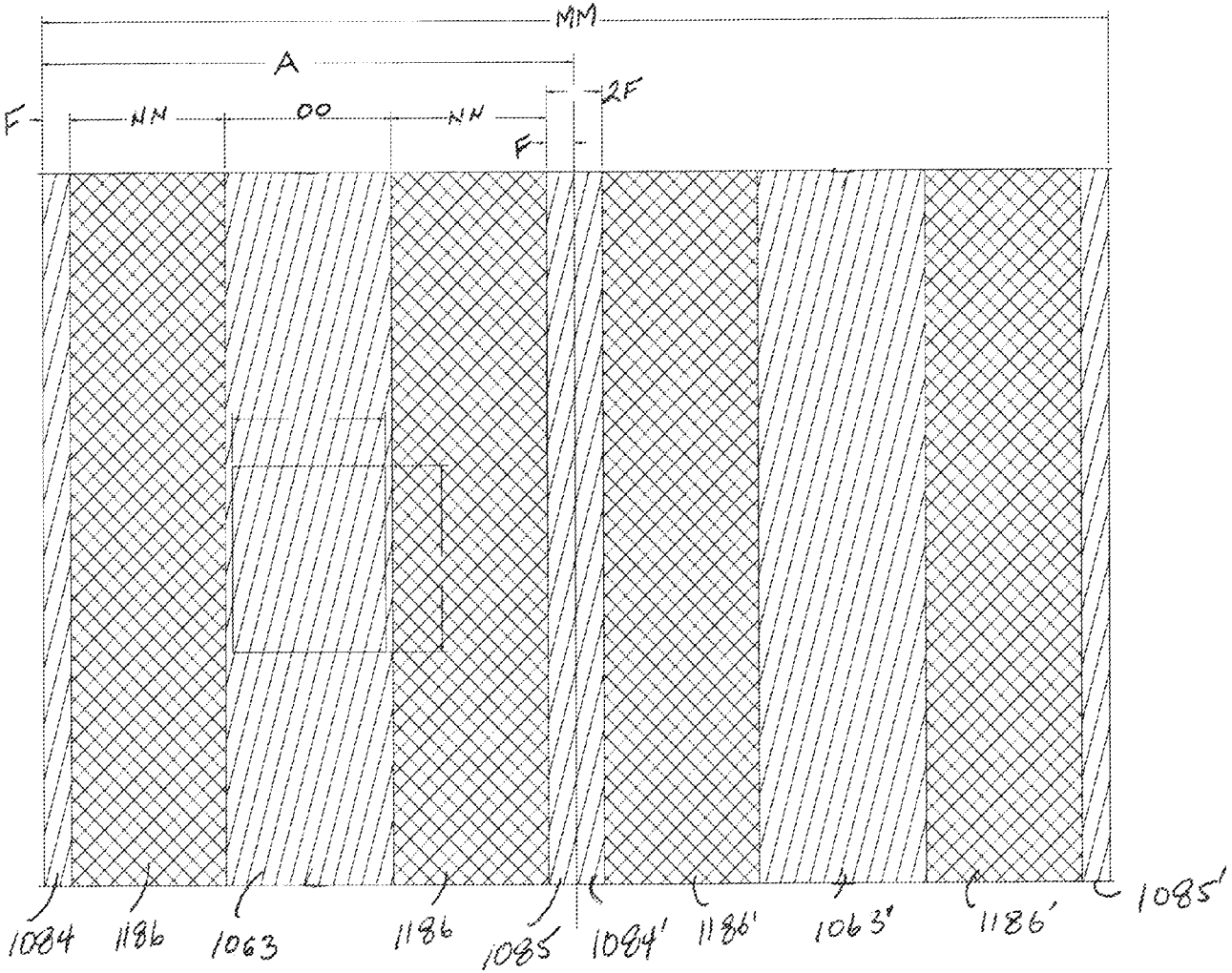
FIG. 15 is an enlarged top plan view of an exemplary adhesive pattern used between two sheets of flexible material, to provide a two-ply bag.

In some instances it will be acceptable and convenient to use a laminating adhesive between the two plies 46, 47 that is continuous and covers the entire area between the plies. In others it will be desirable to use a discontinuous coating, for example as found in U.S. Pat. Nos. 5,753,895; 5,928,554; and 6,049,072, each of which is incorporated herein by reference. An example of a preferred discontinuous adhesive coating pattern between plies 46, 47 is illustrated in FIGS. 15 and 16 of this disclosure and which is described in detail below.

Referring again to FIG. 3, in some instances it will be desirable to provide continuous adhesive at certain locations, and discontinuous adhesive at others. In FIG. 3, the fields indicated at 186, with the dotted print pattern, are indicating a preferred location for having continuous coverage, depending, in part, on the nature of the paper used for the plies 46, 47 and the expected locations of most prolonged oil/fat content. This is because the laminating adhesive can preferably be chosen to provide some beneficial greaseproof effect. In the regions that are not dotted, for example regions 187, 188, 189, it is expected that a discontinuous coverage can be used.

Preferred regions for continuous coverage for the lamination adhesive include the following: regions bounded by: fold lines 68, 69 which form inwardly directed gusset folds 40, 35 respectively, FIG. 4; edge 92*a* and apexes of chevrons formed from fields 103-110; and, remaining regions between fold line 80 and apexes 103*x*, 105*x*, 107*x* and 108*x*, extending out to opposite edges 84*a*, 85*a*, FIG. 3.

Regions where an adhesive pattern (as opposed to complete coverage) for the laminating adhesive, between the plies 46, 47 is preferred comprise: the region 187 bounded by fold line 68, a line 187*a* defined by apexes 103*x*, 105*x*, 107*x* and 108*x*, edge 84*a* and edge 85*a*; the region 188 bounded by fold line 69, fold line 80, edge 85*a* and edge 92*a*; and region 189 bounded by fold line 68, fold line 80, edge 84*a* and edge 92*a*.

It is preferred to have an adhesive pattern, for the laminating adhesive, where possible, to save cost and weight. It is typically preferred to have a continuous adhesive as a laminating adhesive at locations: (a) within panel 21 on which a popcorn charge will sit in a microwave oven during use; (b) within gusset panels 48, 49 integral with and adjacent panel 21; and, (c) within central portions of gusset panels 115, 116 and panel 20, most likely to come into contact with oil/fat during storage, handling or use.

Referring to FIG. 4, when used as insulating seals, preferably sealant fields that form seals 155, 156 are at least 0.25 cm wide, typically and preferably at least 0.5 cm wide, typically about 0.8-1.4 cm wide. In this context the "width" is the distance of extension inwardly, i.e., toward each other, from edges 155*a*, 156*a*, respectively. The seals 155, 156, of course, do not need to be of constant width, although they are shown this way.

III. A Specific Example According to FIGS. 1-5; Preferred Sealant Materials

From the following specific example and general characterizations of preferred materials, a wide variety of applications of the principles of the present invention will be understood.

Consider, for example, a typical popcorn product containing a charge of about 20-90 grams, typically about 60-75 grams of popcorn kernels. The charge may be conventional and also contain oil/fat and/or flavorings, with a total weight of about 85-100 grams. Typically the issue for which the present invention provides advantage, relates to reducing undesired levels of leakage of oil/fat through the package side wall, during storage and handling.

For an example of such an arrangement, see panel 60, FIG. 3, which has a rectangular configuration with outer dimensions of about 11.625 by 21 inches (29.5 cm by 53.3 cm). The various fold lines would be oriented such that region 63, defined by lines 62, would have an outer perimeter of about 5.625 inches by 6.5 inches (14.3 cm by 16.5 cm).

The multi-ply laminate for panel 60 could comprise the following materials, although alternates are possible. The sheet of paper which forms the outer surface of the bag, when folded, could be a 20-25 lb/ream, for example 20-21 (for example, 20.5) blended kraft paper. The sheet of paper which forms the innermost ply could be about a 23 lb/ream (for example 20-25 lb/ream) grease-proof paper. Both papers can, in some applications, be a paper that has been treated with a fluorochemical material to enhance grease resistance. A conventional fluorochemical used is Ciba LoDyne P-208E or DuPont Zonyl 9464.

The microwave interactive arrangement or susceptor 45 would preferably be positioned between the two plies. The microwave interactive material would preferably comprise metallized polyester such as a Saehan America, Fort Lee, N.J. polyester film (typically 48 gauge) vacuum metallized with aluminum to give a density of 0.25+/−0.05 as measured by a Tobias densitometer. Companies which can prepare such a material include Rolvac of Windham, N.H. and Vacumet Corp. of Wood Dale, Ill.

Examples of conventional laminating adhesive for use between the plies 46, 47 include Duracet 12, available from Franklin International, Inc., of Columbus, Ohio and H. B. Fuller PWF 3007, available from H. B. Fuller, St. Paul, Minn. Duracet 12 and PWF 3007 are each polyvinyl acetate adhesives. Other materials could be used as the laminating adhesive. One example is PWF 8540, an ethylene vinyl acetate-polyvinyl alcohol adhesive, also available from H. B. Fuller. PWF 8540 adds greaseproofness, and is particularly useful if a non-fluorocarbon treated paper is used.

In general, for the preferred embodiment described, the same adhesive (for example Duracet 12 or PWF 3007) is utilized as the adhesive at all locations on the side 65 and the opposite surface of the bag blank 60, where sealant is used.

In general, the characteristics of the seal are controlled by the amount of adhesive applied per ream of material. Typically if it is desired that the seal be maintained, even during the popping process, adhesive is applied at a basis weight of about 5 lbs per ream. If the seal is to open during processing, typically about 60% of this amount is used. Another variable that can be managed, to facilitate opening, is to provide a seal region which is relatively narrow. For example at region 92*b*, FIG. 3, a narrow region of adhesive can be used to facilitate venting. These are conventional techniques used in conventional popcorn packaging.

Figure 5:
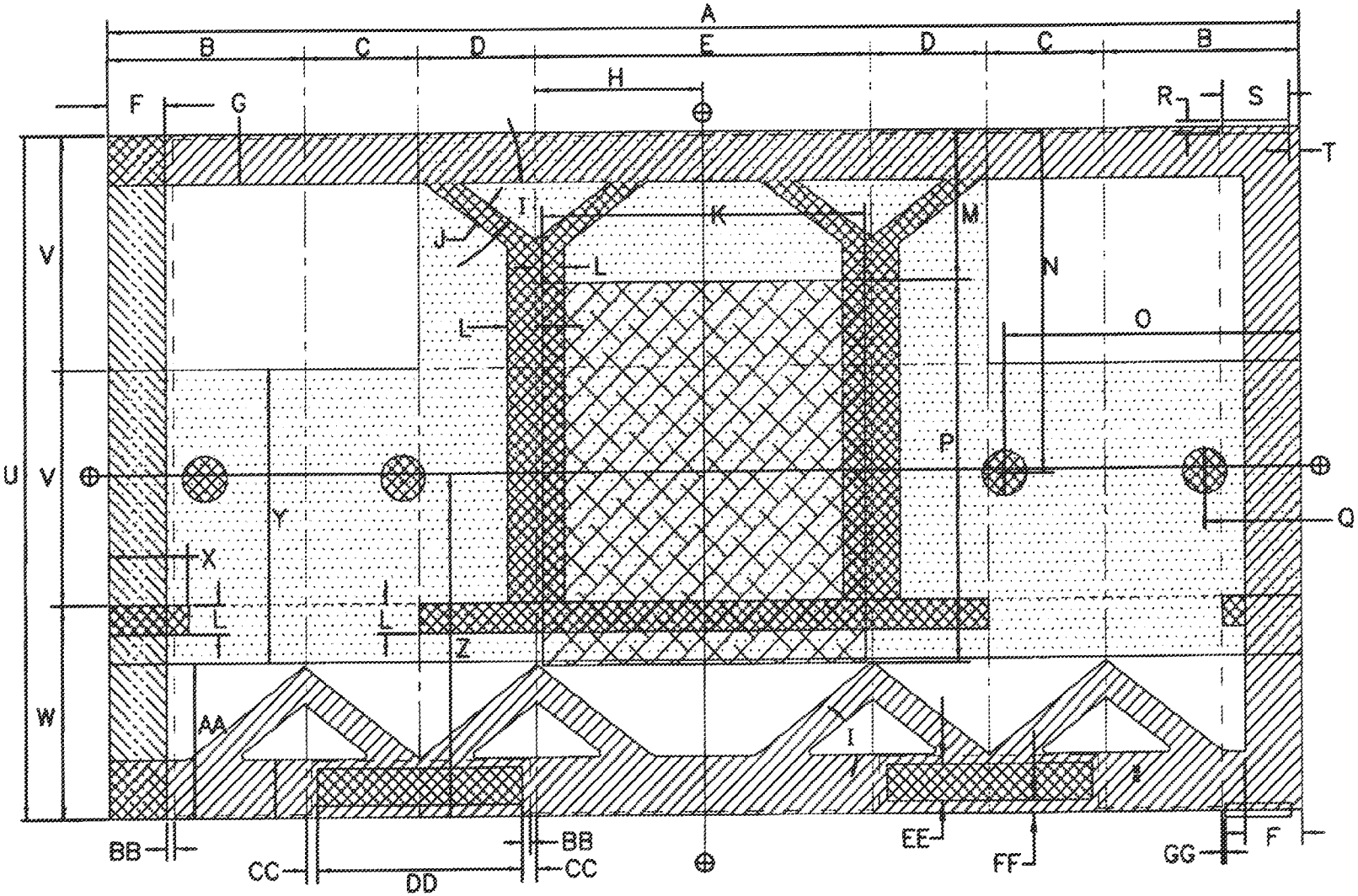
FIG. 5 is a view analogous to FIG. 3, with letters indicating example dimensions found in this text.

Attention is now directed to FIG. 5, in which various dimensions and angles are indicated with letters. The adhesive layout of FIG. 5 corresponds to that of FIG. 3. The dimensions provide an example of a useable package. The dimensions for the particular example shown in FIG. 5 are as follows: (A) 21 inches (53.3 cm); (B) 3.4375 inches (8.73 cm); (C) 2.0625 inches (5.24 cm); (D) 2.0625 inches (5.24 cm); (E) 5.8750 inches (14.9 cm); (F) 1.0 inches (2.54 cm); (G) 0.8579 inches (2.18 cm); (H) 2.9375 inches (7.46 cm); (I) 37°; (J) 0.375 inches (0.953 cm); (K) 5.6250 inches (14.3 cm); (L) 0.5 inches (1.27 cm); (M) 2.5625 inches (6.51 cm); (N) 5.8750 inches (14.9 cm); (O) 5.1875 inches (13.2 cm); (P) 6.5 inches (16.5 cm); (Q) 1.6875 inches (4.29 cm); (R) 0.2 inches (0.51 cm); (S) 1.1562 inches (2.94 cm); (T) 0.1875 inches (0.48 cm); (U) 11.6250 inches (29.5 cm); (V) 4 inches (10.2 cm); (W) 3.625 inches (9.21 cm); (X) 1.375 inches (3.49 cm); (Y) 5.0 inches (12.7 cm); (Z) 5.8125 inches (14.8 cm); (AA) 2.625 inches (6.67 cm); (BB) 0.125 inches (0.32 cm); (CC) 0.250 inches (0.64 cm); (DD) 3.6250 inches (9.21 cm); (EE) 0.6250 inches (1.59 cm); (FF) 0.2188 inches (0.56 cm); (GG) 0.0625 inches (0.159 cm). Other dimensions would typically be to scale.

It is anticipated that arrangements according to the example could readily be formed in a continuous process, from a feed sheet material or stock, having seal material appropriately applied thereon, such as through horizontal form/fill/seal methods or techniques. Conventional folding equipment and equipment for positioning a popcorn charge within the arrangement can be readily used.

IV. Alternate Adhesive Patterns for the Bag Blanks, FIGS. 6-14

A. The Arrangement of FIGS. 6 and 9

Figure 6:
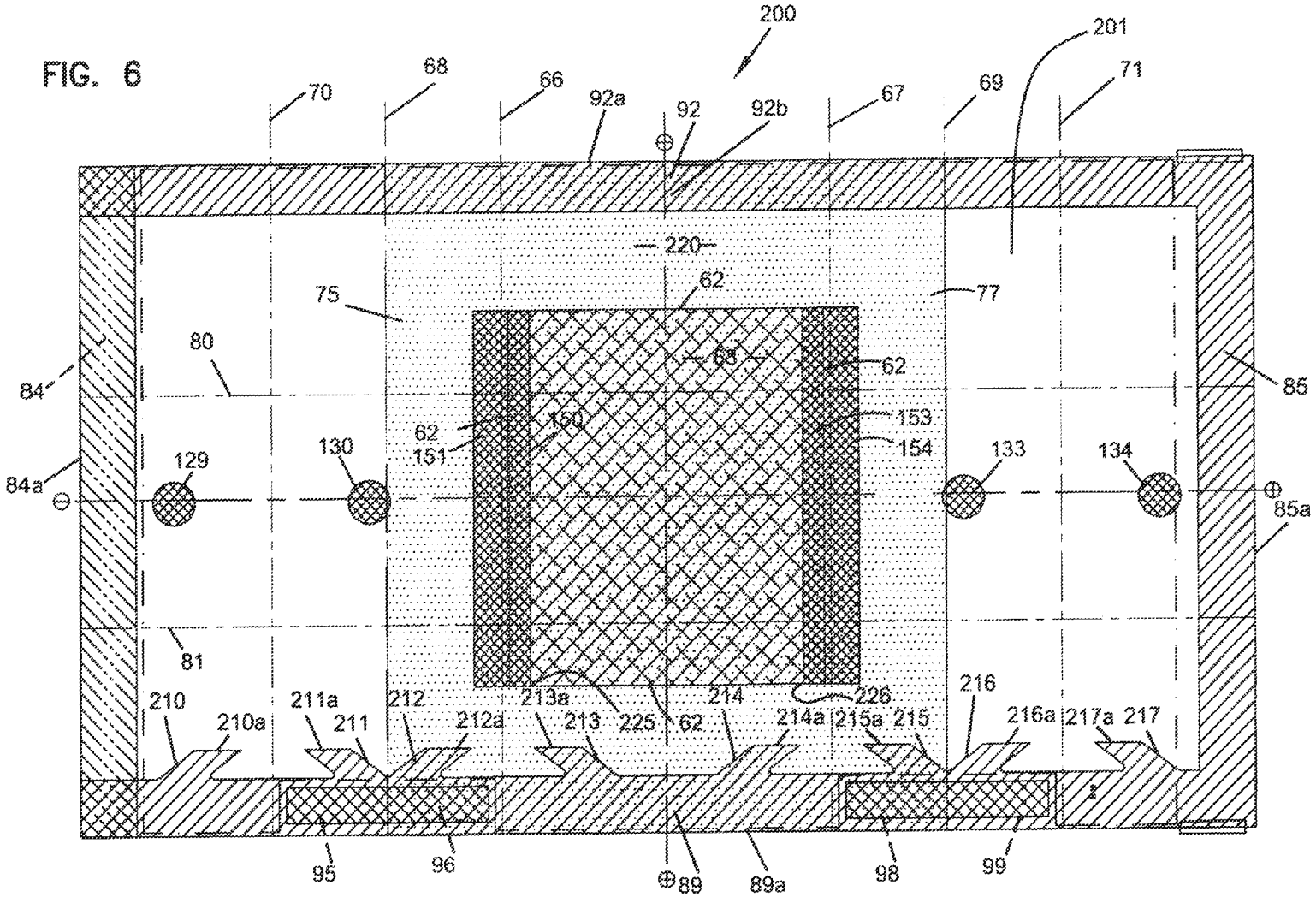
FIG. 6 is an enlarged top plan view of an alternate sheet of flexible material from which the bag according to FIGS. 1 and 2 can be folded; the arrangement of FIG. 6 including markings indicating where adhesive material is preferably positioned in the construction.

Attention is now directed to FIG. 6, which depicts a foldable blank 200 from which the package according to FIGS. 1, 2 and 4 can be folded. Referring to FIG. 6, the view is of side 201, which will form an inside of the package when folded. In FIG. 6, the same reference numerals as used in FIG. 3, are used to reference analogous seal features. A bag would be folded from the arrangement of FIG. 6 using similar techniques of folding and sealing.

Features in the embodiment of FIG. 6 that differ than the arrangement of FIG. 3 relate to the following:

1. Adjacent region 92, which forms the top edge 93 (FIG. 2) of the bag 1 in use, although optional, there are no sealant fields analogous to fields 120, 121, 122 and 123, FIG. 3.
2. Although optional, there are no seals analogous to seals 160, 161, 162, 163, 164, 165 and 166, to form a transverse seal analogous to that shown (and described as optional) in FIG. 3.
3. The chevron shaped seal regions analogous to region 103, 104, 105, 106, 107, 108, 109 and 110, although optional, are absent and are replaced by diagonal sealant fields: 210, 211, 212, 213, 214, 215, 216 and 217, as described below.

Referring first to the absence of fields 120, 121, 122, 123 adjacent seal region 92 in FIG. 6 compared to FIG. 3. As described above in connection with FIG. 3, in region 92*b*, the end seal 93, FIG. 2, will generally be configured to open (vent) during the microwave popping process. Thus, in this region the seal or seam is not configured to be permanent. It is preferred not to have oil/fat migration (during storage, handling or use) extend, substantially, into this region if possible.

It has been found that in some instances, as the oil/fat melts, it will tend to migrate along the seals formed by fields 120, 121, 122, 123 into a concentrated direction toward region 92*b*. This could lead in some instances to undesirable passage of oil outwardly from the bag 1, along seam 93, FIG. 2, during use. For the embodiment of FIG. 6, the avoidance of any diagonal seals adjacent edge seal 92, in this region of the package blank 200, leads to avoidance of this issue. Thus, preferably there are no seals between panel 75 or 77, and central region 220 (bounded by seal 92 and line 62), around fold lines 66, 67, in this region 220 of the preferred package blank 200. Alternatively stated, preferably there are no diagonal gusset seals in region 220 and/or adjacent end 93 (or field 92 and edge 92*a*).

As stated above, preferably there is no transverse seal analogous to FIG. 3 resulting from sealant fields 160-165 (FIG. 3). Alternately stated, there are preferably no transverse seals extending between points 225 and 226 in the final folded product. Although such a transverse seal can be used, one is generally not needed to obtain appropriate control over oil/fat location, in an arrangement according to FIG. 6, and thus can be avoided to a cost savings advantage.

As explained above, sealant fields 103-110 of FIG. 3 are absent in FIG. 6, and in the same location sealant fields 210, 211, 212, 213, 214, 215, 216 and 217 are provided. Each one of fields 210-217 comprises a diagonal extension of adhesive or sealant extending in a direction toward one of fold lines 66, 67, 70, 71, from sealant field 89, but is truncated short of the associated sealant field. By "diagonal" in this context, it is meant that each field extends in a direction non-parallel to one of side edges 84*a*, 85*a*, toward an associated one of the fold lines 66, 67, 70, 71. By "truncated short of the fold line," it is meant that the field does not extend into intersection with the associated fold line. Herein, the reference to an "associated" fold line means, for a given field 210-217, the closest fold line toward which the field extends, in extension from edge field 89. It is noted that fields 210-217 are shown continuous in extension from field 89. In some arrangements, the fields 210-217 could be discontinuous, i.e., have breaks or patterns therein.

Still referring to FIG. 6, fields 210-217 can be understood to comprise four pairs of fields as follows: fields 210, 211, each directed toward associated fold line 70; fields 212, 213, each directed toward associated fold line 66; fields 214, 215, each directed toward associated fold line 67; and fields 216, 217, each directed toward associated fold line 71.

Referring to fields 210, 211, in the preferred embodiment shown each is integral with field 89, and begins in extension toward fold line 70, from field 89, at a location spaced at least 0.5 inches (12.5 mm) from the fold line, typically at least 0.75 inches (19 mm). Further, preferably each is spaced an equal amount from the fold line 70, on an opposite side from the other. Further, each preferably extends at an acute angle relative to the fold line 70, within the range of about 25 to 45°, typically about 35-40°. Further, each preferably extends in an acute angle, relative to edge 89*a*, within the range of about 25 to 45°, typically about 35-40°.

Each of the sealant fields 210, 211 projects to an end spaced inwardly, from field 89, a distance of at least 0.25 inches (6.4 mm), typically 0.25-0.75 inches (6.4-19 mm). A typical extension inwardly measured relative to edge 89*a* would be at least 1.25 inches (31.8 mm), typically 1.25-1.75 inches (31.8-44.5 mm).

For the particular arrangement shown, each of fields 210, 211 has an inner most surface 210*a*, 211*a*, that extends parallel to edge 89*a*, although alternatives are possible.

In general, fields 210, 211 comprise truncated legs of a chevron, i.e., a portion of an incomplete chevron, the apex (corresponding to apex 103*x*, FIG. 3) being absent. Thus, if completed, i.e., not truncated, the chevron would generally be analogous to that formed from fields 103, 104, FIG. 3. Comparing FIG. 6 to FIG. 3, fields 210, 211 comprise the wide base of the chevron, adjacent field 89, with an incomplete peak, apex or point (103, FIG. 3). As a result, fields 210, 211 form a diagonal edge of seal in a gusset resulting from a fold around fold line 70, with appropriate application of heat and pressure or other means to seal field 210 to field 211, without adhesive immediately adjacent fold line 70.

Fields 212, 213 (with ends 212*a*, 213*a*) are preferably analogous to fields 210, 211, except positioned around fold line 66. Fields 214, 215 (with ends 214*a*, 215*a*) are preferably analogous to fields 210, 211, except positioned around fold line 67. Fields 216, 217 (with ends 216*a*, 217*a*) are preferably analogous to fields 210, 211, except positioned spaced around fold line 71.

Figure 9:
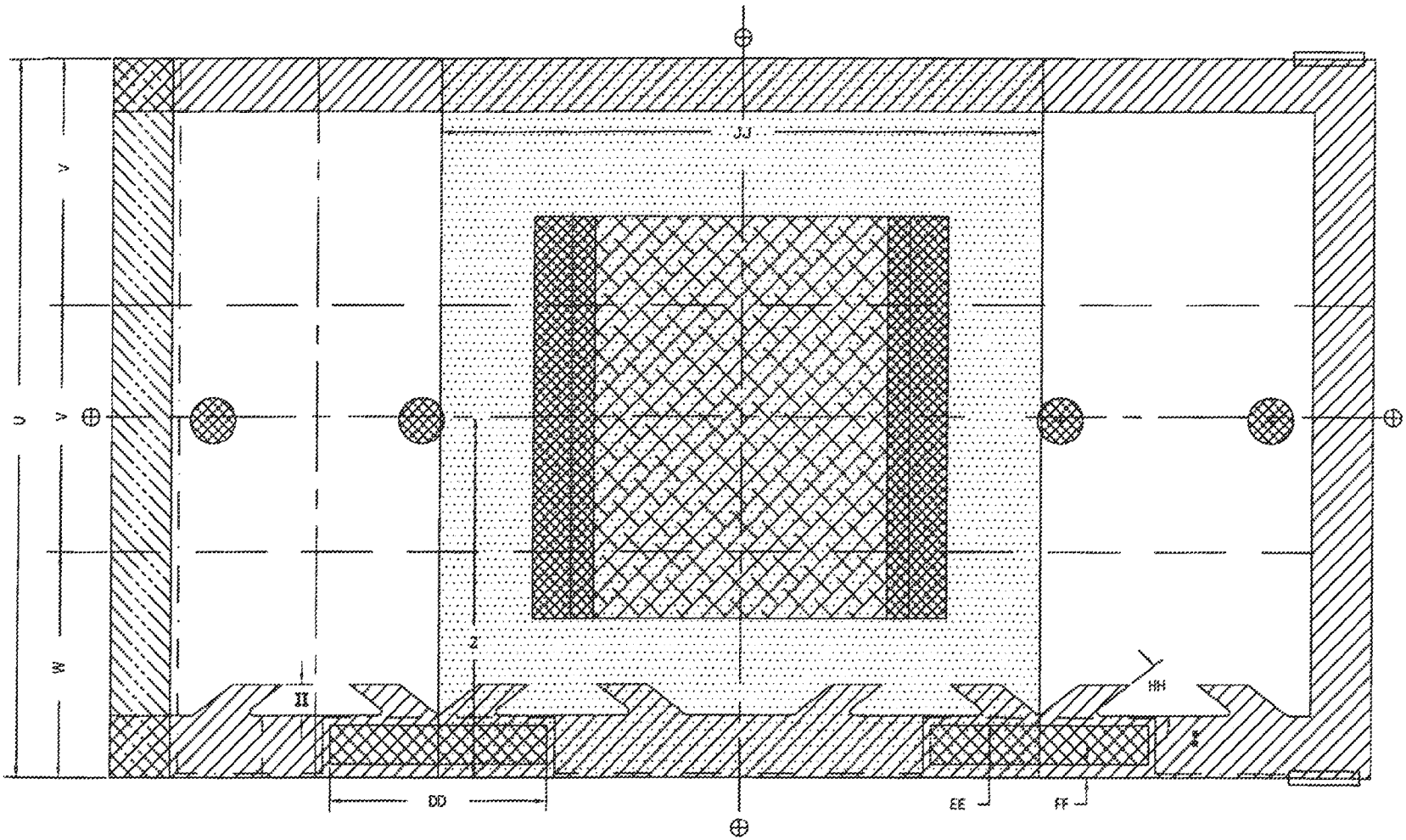
FIG. 9 is a view analogous to FIG. 6, with letters indicating example dimensions found in this text.

Attention is directed to FIG. 9, in which the package blank of FIG. 6 is shown, with letters indicating dimensions. The dimensions indicated by the same letters are analogous to those recited above in connection with FIG. 5. Other dimensions are as follows: (HH)=37°; (II)=0.5 inch (12.7 mm); (JJ)=10 inch (254 mm). Other dimensions would be derived from the scale of FIG. 9.

In FIG. 6, a dotted pattern bounded by edges 92*a*, 89*a* and fold lines 68, 69, indicates a preferred location for complete laminant adhesive coverage, between plies used to form blank 200. Regions not shown in this dotted pattern are regions where, if desired, pattern laminant opposed to a complete continuous laminant, could be used. In general complete laminant is preferred where there is likely to be most contact with oil/fat, since the laminant can improve greaseproofness. Laminant patterns can be used to save cost with respect to lamination adhesive and also to improve manufacture ability.

It was noted above that for the embodiment of FIG. 6, although optional, sealant fields 120-123, FIG. 3, are not used. It is noted that it was optionally chosen to use such fields, that full chevrons or truncated chevrons analogous to field 212-215, positioned appropriately at region 220, could be used.

B. The Arrangement of FIGS. 7 and 10

Figure 7:
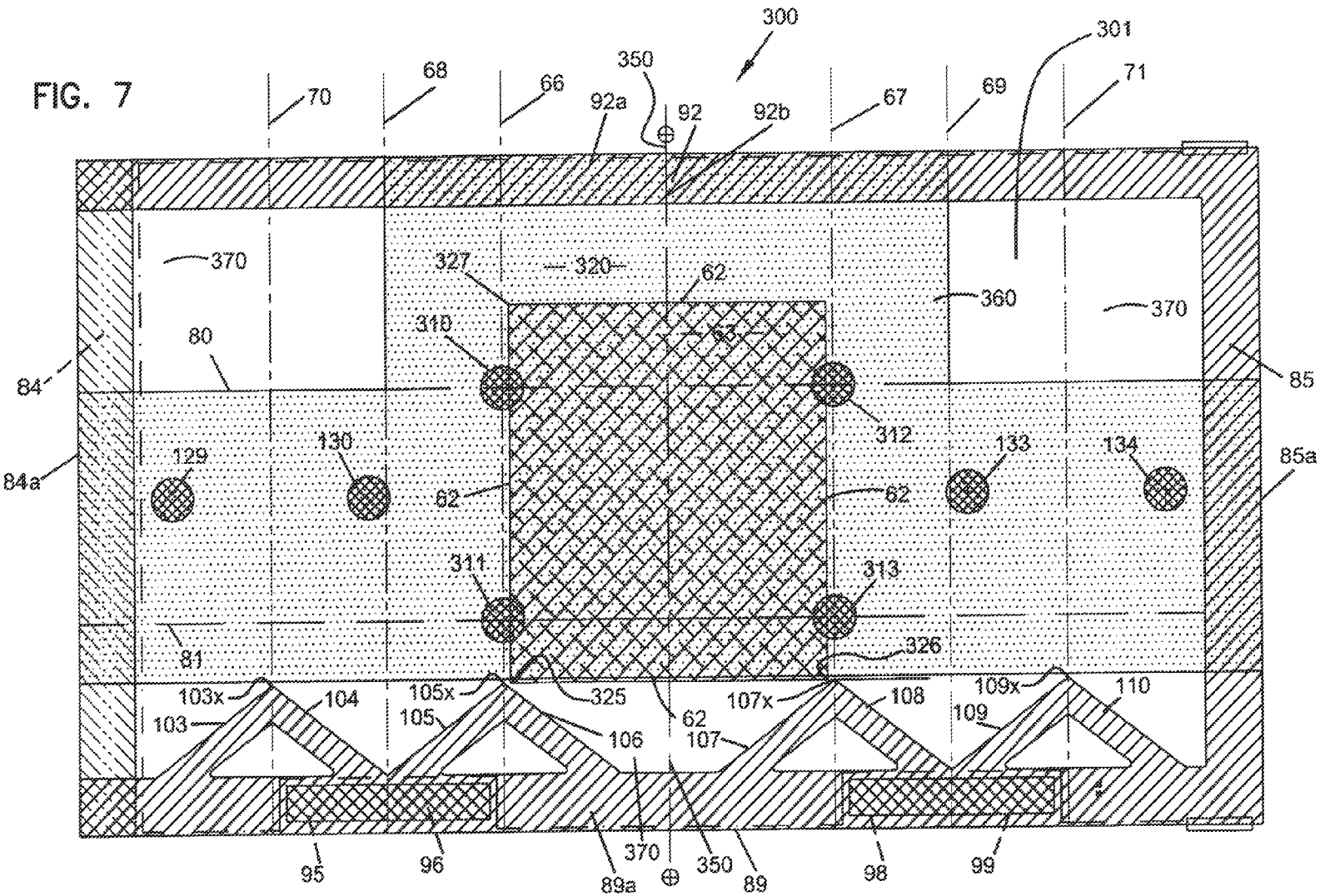
FIG. 7 is an enlarged top plan view of a second alternate sheet of flexible material from which a bag such as that shown in FIGS. 1 and 2 can be folded; the arrangement of FIG. 7 including markings indicating where adhesive material is preferably positioned in the construction.

In FIG. 7, package blank 300 is shown, from which a bag according to FIGS. 1 and 2 can be formed. As will be understood from the following, a bag, with a popcorn charge therein, folded from bag blank 300 would have a cross-section similar to FIG. 4, except for appearance the seals 155, 156, intersected by the cross-section line. In FIG. 7, the view of blank 300 is of side 301, which will form the interior surface of the microwave popcorn bag, when folded. In FIG. 7, the same reference numerals as used in FIGS. 3 and 6 indicate the same parts with analogous functions.

The arrangement of FIG. 7 differs from the arrangement of FIG. 3 with respect to the following:

1. Although optional, there are no diagonal adhesive fields corresponding to fields 120, 121, 122, 123 adjacent seal region 92.
2. Although optional, there is no transverse seal analogous to that formed by regions 160, 161, 162, 163, 164, 165, 166.
3. There are no continuous (full) gusset fold insulating seals 155, 156 (FIG. 4) shaped like those formed by fields 150, 151 around fold line 66 and fields 153, 154 around fold line 67. Rather in place of these, spaced gusset fold seals 310, 311, 312 and 313 are provided.

Avoidance of seals 120-123 (FIG. 3) adjacent region 92 provides an effect analogous to that discussed above with respect to FIG. 3. Thus, preferably region 320, between fold lines 66 and 67 (and bound by sealant fields 92 and line 62) is devoid of any diagonal gusset seal therein.

The avoidance of fields 160-166, FIG. 3, leads to the avoidance of a transverse seal between points 325, 326. Although a transverse seal could be used at this location, it is not necessary and its avoidance can lead to cost savings and manufacturing flexibility.

The avoidance of continuous (full) gusset fold insulating seals provided by regions 150, 151 and 153, 154 (FIGS. 3 and 6) means that in some regions gusset folds around lines 66, 67 would not be insulated by a continuous seal, from contact with oil/fat. Although such seals (FIGS. 3 and 6) provide for a good insulating affect, it has been found that in some instances the liquefied oil/fat will tend to migrate along the resulting seal line (edge of seals 155, 156 FIG. 4 directed toward region 21*a*) toward the end seal 93 at 93*a*, FIG. 2, i.e., toward region 92*b*, FIG. 7. This can cause undesirable levels of oil/fat loss from the bag 1, for example during popping.

Attention is now directed to fields 310, 311, 312, 313. Referring first to fields 310, 311, each is positioned over fold line 66. Thus when folded and sealed, each of fields 310, 311 will provide a seal in gusset fold 39, FIG. 4. The location of these seals is such that they will help keep gusset fold 39 collapsed closed and pinched near gusset fold 34, FIG. 4, until a microwave popcorn popping operation is conducted in a microwave oven. Thus, they will tend to inhibit migration of the oil/fat into a region adjacent gusset fold 32, by their operation to keep gusset panel 48, FIG. 4, collapsed and secured to adjacent face pane 21, FIG. 4, at certain spaced locations. However, since they do not extend completely along line 66 between points 325 and 327, they will not create a seal line that might tend to direct liquefied oil/fat flow during a microwave operation, or during production, distribution and storage toward region 92*b* (i.e., toward region 93*a* of bag 1, FIG. 2). Referring to FIG. 7, the preferred field 310 shown has the following characteristics:

1. it is spaced from field 311 by at least 1 inch (25.4 mm), typically at least 2 inches (50.8 mm), preferably at least 3 inches (76.2 mm), most preferably 4 inches (101.6 mm) or more;

2. it is defined by a perimeter area of no greater than 1.8 sq. in. (11.6 sq. cm) and typically no greater than 0.8 sq. in. (5.2 sq. cm), preferably at least 0.04 sq. in. (0.26 sq. cm) and usually at least 0.05 sq. in. (0.32 sq. cm);

3. it is positioned in overlap with region 63, and projects into region 63 by a distance of at least 0.06 inch (1.5 mm), typically at least 0.12 inch (3.0 mm);

4. it is positioned spaced along fold line 66, toward end 89*a*, from point 327 (which defines the end of the susceptor 45 nearest toward sealant field 92) by at least 0.5 inch (12.7 mm), and typically at least 0.75 inch (19 mm), and usually not more than 2 inches (50.4 mm); and 5. it is located along fold line 66 at an intersection with fold line 80, which forms tri-fold 2, FIG. 2.

Similarly, the preferred field 311 shown has the following characteristics:

1. it is spaced from field 310 by at least 1 inch (25.4 mm), preferably at least 2 inches (50.8 mm), typically at least 3 inches (76.2 mm);

2. it is defined by a perimeter area of no greater than 1.8 sq. in. (11.6 sq. cm) and typically no greater than 0.8 sq. in. (5.25 sq. cm); preferably at least 0.04 sq. in. (0.26 sq. cm) and usually at least 0.05 sq. in. (0.26 sq. cm);

3. it is positioned on overlap with region 63, and projects into region 63 by a distance of at least 0.06 inch (1.5 mm), typically at least 0.12 inch (3.0 mm);

4. it is positioned spaced along fold line 66 toward end 92*a*, from point 325 (which defines an end of the susceptor 45 extension toward field 89) by at least 0.2 inch (5 mm) and typically at least 0.3 inch (7.6 mm), and usually not more than 2 inches (50.4 mm); and, 5. it is positioned at an intersection between fold line 81 (which forms fold 12, FIG. 2) and fold line 66 (which forms fold 34, FIG. 4).

Although alternatives are possible, for the preferred arrangement depicted in FIG. 7, field 312 is analogous to field 310 except positioned on fold line 67 spaced from field 313. Preferably field 312 is positioned as a mirror image of field 310, around center line 350, i.e., field 312 is analogously positioned over fold line 67; and field 313 is analogous to filed 311, preferably positioned as a mirror image of field 311 around center line 350 and over fold line 67.

After folding, from bag blank 300, a bag configuration according to FIG. 2 and analogous to FIG. 4 (except for fields 155, 156), as a result of the fields 310-313, will: (a) maintain opposite gusset folds 34, 39 (FIG. 4) pinched closed, to inhibit oil/fat from coming into contact with the fold line to an undesirable extent, during storage and handling and thus inhibiting wicking; and (b) will tend to inhibit flow toward region 92*b* during a microwave popcorn operation, relative to the arrangement of FIG. 3, since liquid flow that encounters regions 310, 312 is not directed along a direct course toward field 92. It is noted that the seals formed from regions 310-313 can be made to release, during the microwave popping operation, if desired.

It is seen that for the arrangement of FIG. 7, fields 103-110 are present as complete chevrons. Arrangement analogous to that shown in FIG. 6, for fields 210-217, could be used.

It is noted that in region 320 no chevrons analogous to those formed from fields 120-123, FIG. 3, are shown. These could optionally be used if desired. In addition, as an optional variation, fields analogous to those resulting from fields 212-215, FIG. 6, could be used at this location.

Figure 10:
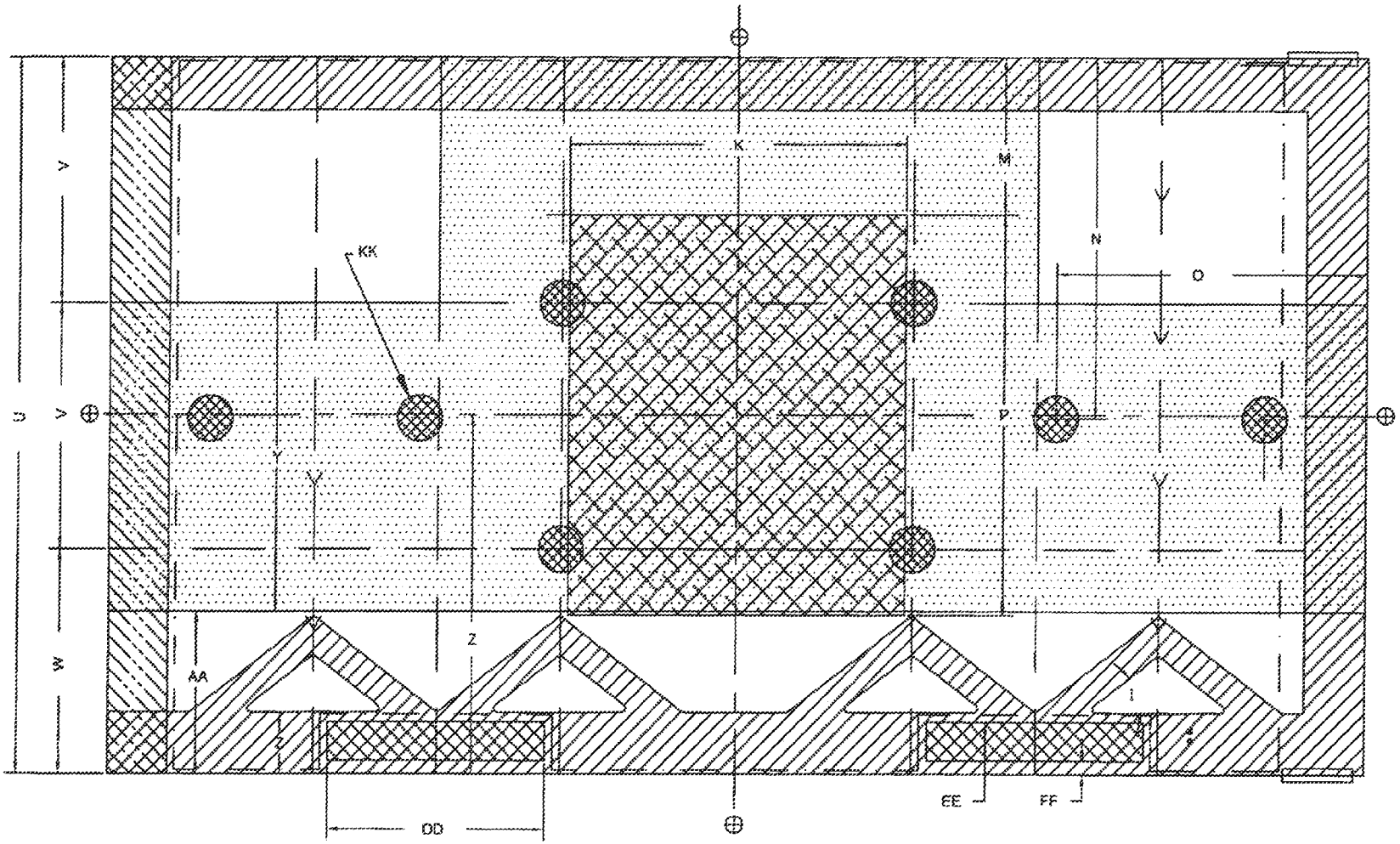
FIG. 10 is a view analogous to FIG. 7, with letters indicating example dimensions found in this text.

Attention is now directed to FIG. 10, which shows the package blank 300 with letters indicating dimensions provided herein. Letters designations the same as used in FIGS. 5 and 6, indicate the same example dimensions. Certain other dimensions are as follows: (KK)=0.75 inch diameter (19.05 mm). Other dimensions would be to scale.

Referring again to FIG. 7, locations were a full coating of laminating adhesive is preferred, between the plies, are indicated at 360 by a dotted print pattern. Regions 370, where no dotted print pattern is present, are regions where full lamination coverage could be used; alternatively, a patterned laminant adhesive (in complete coverage, could be used in regions 370 to avoid excessive adhesive use. The preferred regions of complete laminating adhesive coverage for the arrangement of FIG. 7 are analogous to the ones described above for FIG. 3 and different to the ones described for FIG. 6.

C. The Arrangement of FIGS. 8 and 11

Figure 8:
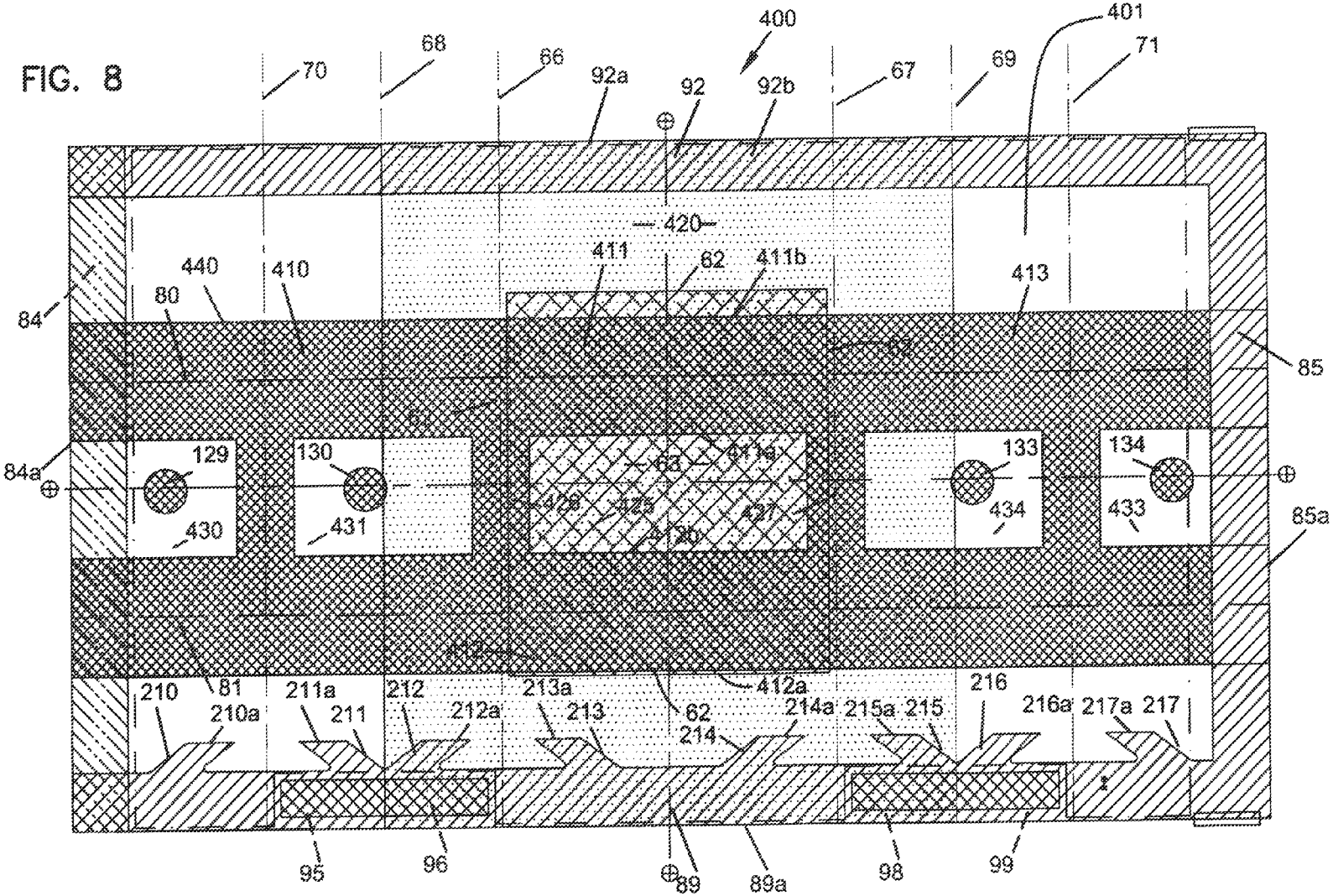
FIG. 8 is an enlarged top plan view of a third alternate sheet of flexible material from which a bag such as that shown in FIGS. 1 and 2 can be folded; the arrangement of FIG. 8 including markings indicating where adhesive and surface treatment material is preferably positioned in the construction.

In FIG. 8, package blank 400 is shown, for folding a bag according to FIGS. 1 and 2, which, if optional gusset fold insulating seals are used, will provide, with an unpopped popcorn charge therein, a bag having a cross-section according to FIG. 4. In FIG. 8, the side 401 of package blank 400 viewable is the side which will form the inside of the bag 1, after folding.

In FIG. 8, the same reference numerals are used as in FIGS. 3, 6 and/or 7, for analogous parts. The arrangement of FIG. 8 differs from the arrangement of FIG. 3, in the following manners:

1. Although optional, fields analogous to fields 120, 121, 122,123 are not used.
2. Fields analogous to fields 160, 161, 162, 163, 164, 165, 166, for forming a transverse seal, are not present.
3. Although optional, chevron fields analogous to fields 103, 104, 105, 106, 107, 108, 109, 110, are not present.
4. Diagonal adhesive regions 210, 211, 212, 213, 214, 215, 216, 217 are present, analogously to the embodiment of FIG. 6.
5. Surface treatment fields 410, 411, 412 and 413 are present.

Adhesive fields 120-123 are avoided to advantage, as discussed above in connection with FIGS. 6 and 7. Thus, region 420 is provided between fold lines 66, 67, and field 92 and line 62 without any diagonal adhesive fields therein, to advantage. Fields analogous to fields 120-123, FIG. 3, could optionally be used in region 420. Further regions analogous to fields 212-215 could optionally be used in region 420.

A transverse seal from fields 160-166 could be used, but it is not necessary and its avoidance leads to costs savings and manufacturing flexibility.

Fields 210-217 are analogous to the same fields described in connection with FIG. 6, and their use (as opposed to chevron fields) leads to cost savings and manufacturing flexibility.

Fields 410, 411, 412, 413 indicate locations in which surface treatment agent (typically adhesive) is applied to surface 401. Application of the surface treatment agent to the surface 401 changes the surface tension characteristics of the surface 401 with respect to flow of oil/fat thereacross. In general, use of a preferred treatment agent in fields 410-413 which is relatively hydrophilic in nature, provides for regions in surface 401 that resist the flow of the oil/fat thereacross. This means that the fields 410-413, even in the absence of a seal involving them, will tend to inhibit oil/fat flow into undesirable directions.

Attention is directed to region 425, positioned over a central area of the blank 400, and in a region of panel region 21*a*, FIG. 4, where the microwave popcorn charge including oil/fat would typically be positioned in the folded bag arrangement. Region 425 is devoid of added surface treatment agent (e.g., adhesive) thereon. Thus, in region 425, the paper surface is directly exposed to the oil/fat.

Around region 425 are positioned fields 411, 412 joined by side regions 426, 427. These will tend to contain the oil/fat against flow out of region 425. That is, untreated region 425, which will be located on region 21*a* (FIG. 4, when the bag 1 is folded) is surrounded by, or circumscribed by, adhesive.

Typically and preferably field 411 is at least 1 inch (25.4 mm) in extension between edges 411*a*, 411*b*, typically at least 1.5 inches (38.1 mm) and usually 1.5 (38.1 mm) to 3 inch (76.2 mm). Field 412 typically has analogous dimensions between regions 412*a* and 412*b*. Preferably fields 411 and 412 extend continuously between fold lines 66, 67.

Field 410 preferably includes a portion continuous in extension between fold lines 66 and side edge 84*a*. Similarly field 413 includes at least a portion continuous in extension between fold line 67 and edge 85*a* (i.e., into intersection with region 85).

Within field 410 are provided two untreated (but surrounded by a portion of treatment agent field 410), regions 430, 431, in which fields 129, 130 (respectively) are positioned. Regions 430, 431 provide for an isolation so that sealant fields 129, 130 can be sealed to one another, upon folding around fold line 70 without undesirably sealing portions of field 410 to one another.

Analogously within field 413 are provided untreated areas 433, 434 around fields 134, 133, respectively.

Preferably, field 410 continuously covers in extension between fold line 66 and edge 84*a*, and between lines 440, 441, except for regions 430, 431. Preferably the perimeter area of regions 430, 431 is at least 1 sq. in. (6.4 sq. cm), typically at least 2.25 sq. in. (14 sq. cm), preferably not greater than 7 sq. in. (15 sq. cm). Within region 430, preferably region 129 is positioned spaced at least 0.1 inch (2.5 mm), typically at least 0.3 inch (7.6 mm), from any portion of field 410, other than region 84. Similarly, preferably within region 431, region 130 is spaced at least 0.1 inch (2.5 mm), preferably at least 0.3 inch (7.6 mm), from any portion of field 410. Preferably region 129 does not overlap region 84, but is spaced therefrom by at least 0.1 inch (2.5 mm).

Preferably line 440 extends parallel to and spaced from fold line 80, toward edge 92*a*, by a distance of at least 0.5 inch (12 mm), typically at least 0.75 inch (14 mm); and, line 441 extends parallel to and spaced from fold line 81 toward end 89*a*, by a distance of at least 0.5 inch (12 mm) typically at least 0.75 inch (14 mm). As a result, when the bag 1 is folded and then folded into a tri-fold 2 around fold lines 11, 12, portions of field 410 will extend to both sides of the fold lines 11, 12.

Field 413 is generally analogous to field 410 when sized and positioned analogously, except on an opposite side of fold line 67. Field 413 preferably extends continuously between fold line 67 and region 85, except where regions 433 and 434 are located. Preferably within region 433, region 134 is spaced from any portion of field 413 or end seal region 85. Preferably within region 434, region 133 is positioned spaced at least 0.1 inch (2.5 mm) and more preferably at least 0.3 inch (7.6 mm) from any portion of region 434. Preferably region 434 has a perimeter size similar to region 431. Preferably region 433 has a perimeter size similar to region 430. It is noted that at region 85, field 413 merges into region 85.

It is noted that insulating seals analogous to seals 155, 156, FIG. 4, could be formed adjacent fold line 66, 67, respectively, if desired. However in some embodiments it may be preferred not to provide such seals at this location.

In use, sealant fields 410, 411, 412, 413 would generally not be sealed, except adjacent edges 84*a*, 85*a* and optionally adjacent fold lines 66, 67. Rather, these fields indicate zones where, as a result of the application of the adhesive or surface treatment agent, the surface tension properties (such as surface energy) of the paper has been modified to advantage, such as for control of oil/fat flow characteristics during use.

Figure 11:
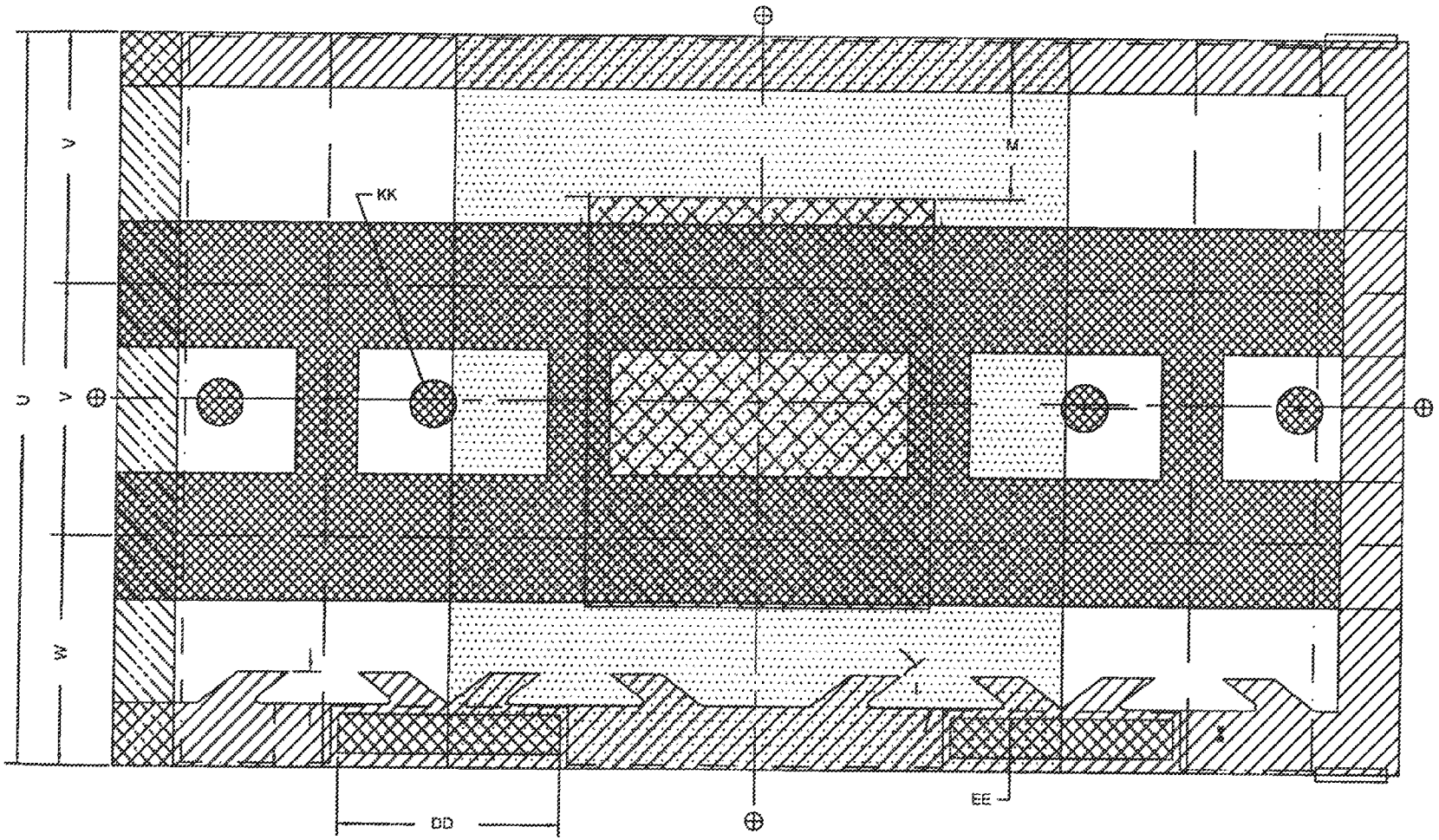
FIG. 11 is a view analogous to FIG. 8, with letters indicating example dimensions found in this text.

Attention is now directed to FIG. 11 which shows bag blank 400 with letters indicating example dimensions. Letters analogous to those used in previous FIGS. 5, 7 and 10 show the same example dimensions. Other dimensions can be derived from FIG. 11, which is to scale.

D. The Arrangement of FIG. 12

Figure 12:
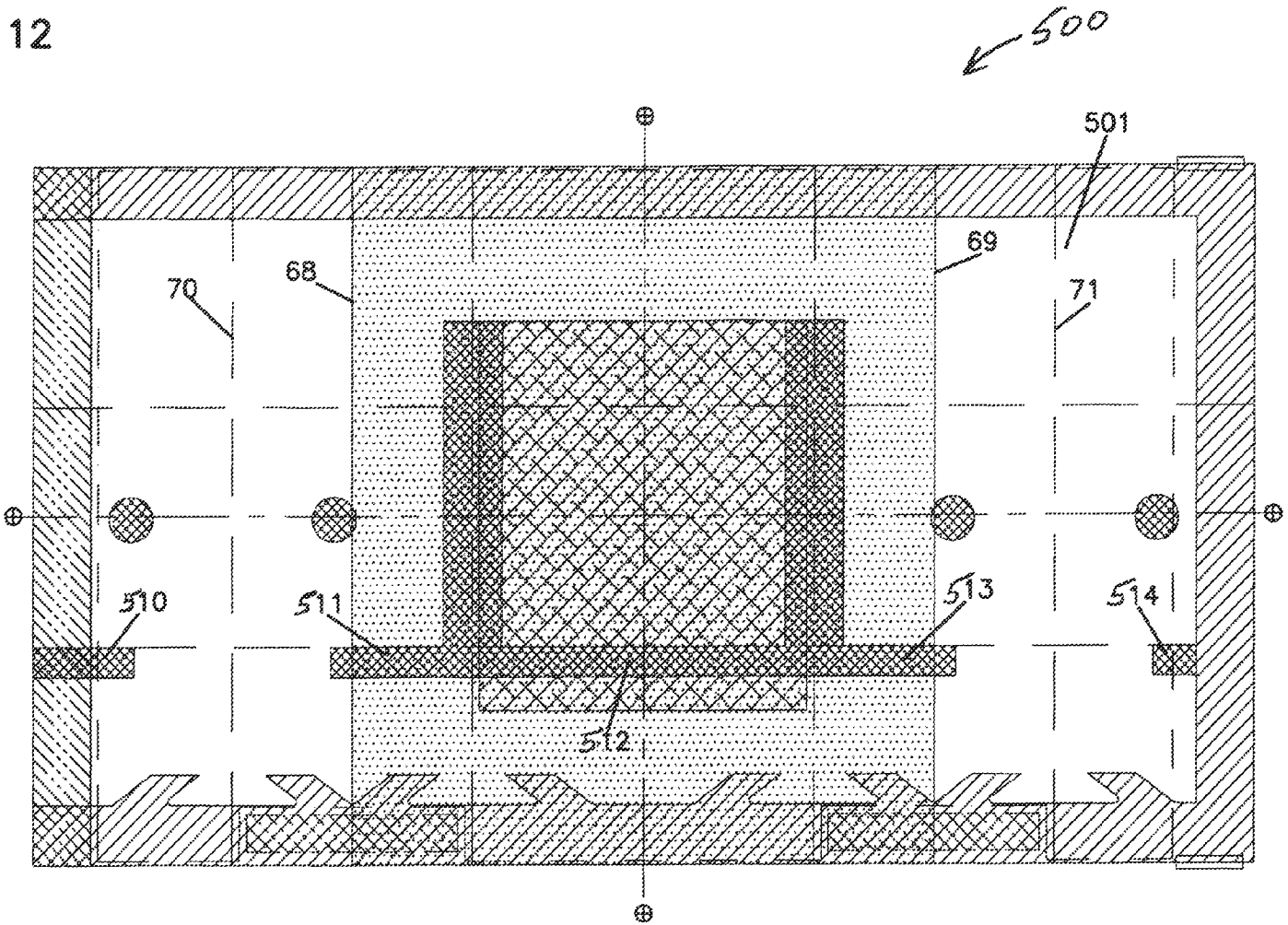
FIG. 12 is an enlarged top plan view of a fourth alternate sheet of flexible material from which a bag such as that shown in FIGS. 1 and 2, can be folded; the arrangement of FIG. 12 including markings that indicate where adhesive is preferably positioned in the construction.

Reference numeral 500, FIG. 12, shows side 501 of a package blank according to a fourth alternate embodiment of the present disclosure. The package blank 500 is generally analogous to package blank 200, FIG. 6, except for the presence of a transverse seal field provided by sealing regions 510, 511, 512, 513, 514. When the package blank 500 is folded into a bag, engagement among regions 510-514 will cause a transverse seal similar to that optionally described in connection with FIG. 3, folding from sealing regions 160, 161, 164, 163, 162, 165, 166. It is noted, however, that although analogous, regions 510-514 have different dimensions, in particular region 511 extends beyond fold line 68, region 510 extends further toward fold line 70, region 513 extends beyond fold line 69 and region 514 extends more toward fold line 71 by comparison to the analogous regions of FIG. 3.

Dimensions would be generally analogous to those described above in connection with FIG. 9, except modified to accommodate the transverse seal. The dimensions for the transverse seal can be taken from FIG. 12, which is to scale with respect to sealant field size and location.

E. The Arrangement of FIGS. 13 and 14

Figure 13:
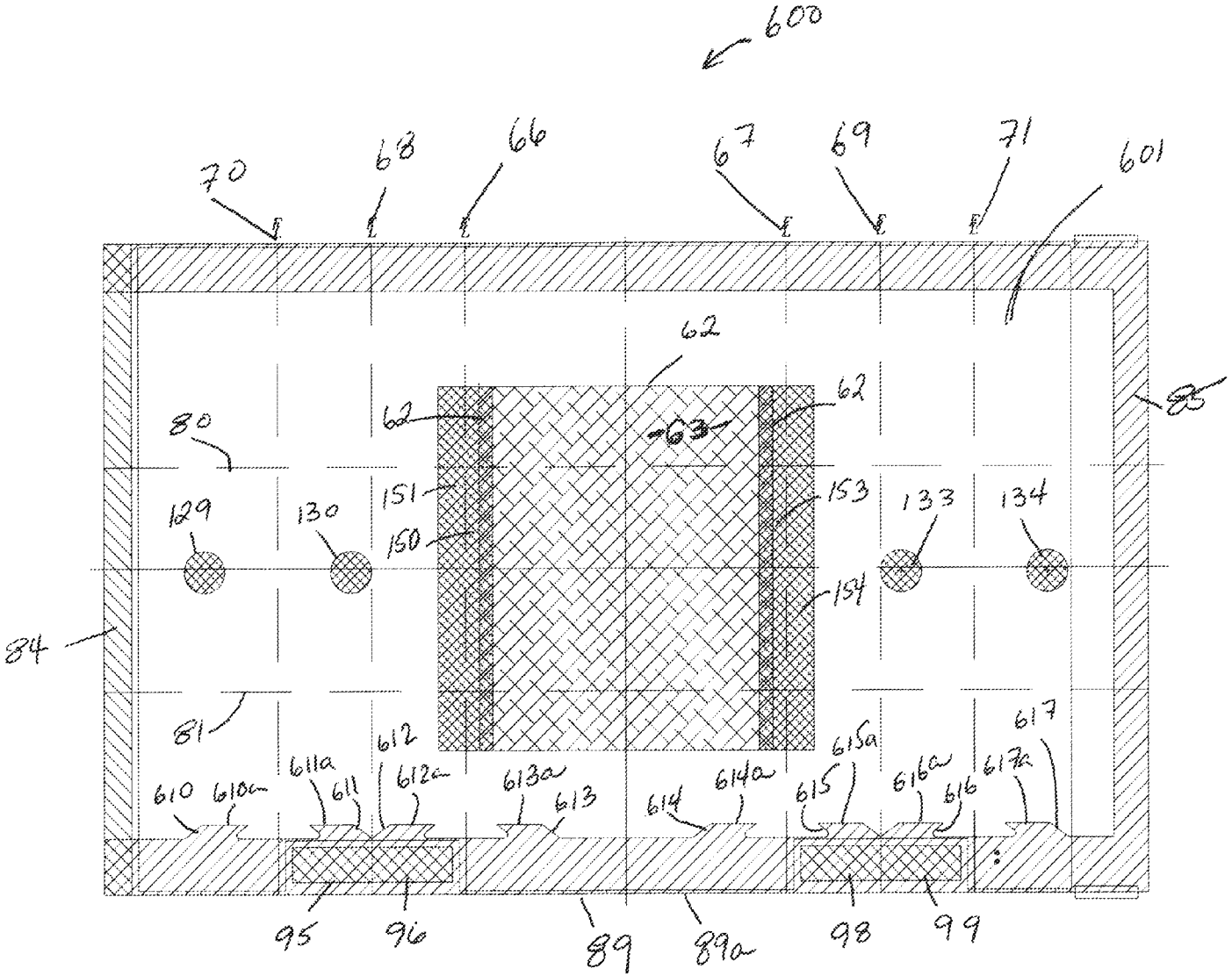
FIG. 13 is an enlarged top plan view of a fifth alternate sheet of flexible material from which a bag such as that shown in FIGS. 1 and 2, can be folded; the arrangement of FIG. 13 including markings that indicate where adhesive is preferably positioned in the construction.

Reference numeral 600, FIG. 13, shows side 601 of a package blank according to a fifth alternate embodiment of the present disclosure. The package blank 600 is generally analogous to package blank 200, FIG. 6, except for the lack of adhesive in the region bounded by and between fold lines 68, 69 other than region 63. That is, package blank 600 has region 63 for receipt of susceptor 45, with region 63 defined by border 62 and fields 150, 151 around fold line 66 and fields 153, 154 around fold line 67, but package blank 600 does not include regions 75, 77 and other adhesive areas between fold lines 68, 69 other than those associated with region 63 and diagonal sealant fields discussed below.

Additionally, blank 600 differs from blank 200 in that diagonal sealant fields 210, 211, 212, 213, 214, 215, 216, 217 of blank 200, FIG. 6, are replaced with diagonal sealant fields 610, 611, 612, 613, 614, 615, 616, 617 having innermost surface 610*a*, 611*a*, 612*a*, 613*a*, 614*a*, 615*a*, 616*a*, 617*a*, respectively, extending parallel to side edge 89*a*. Although analogous to regions 210-217 of blank 200, FIG. 6, regions 610-617 have different dimensions; regions 210-217 extend farther from side edge 89*a* than do regions 610-617.

Figure 14:
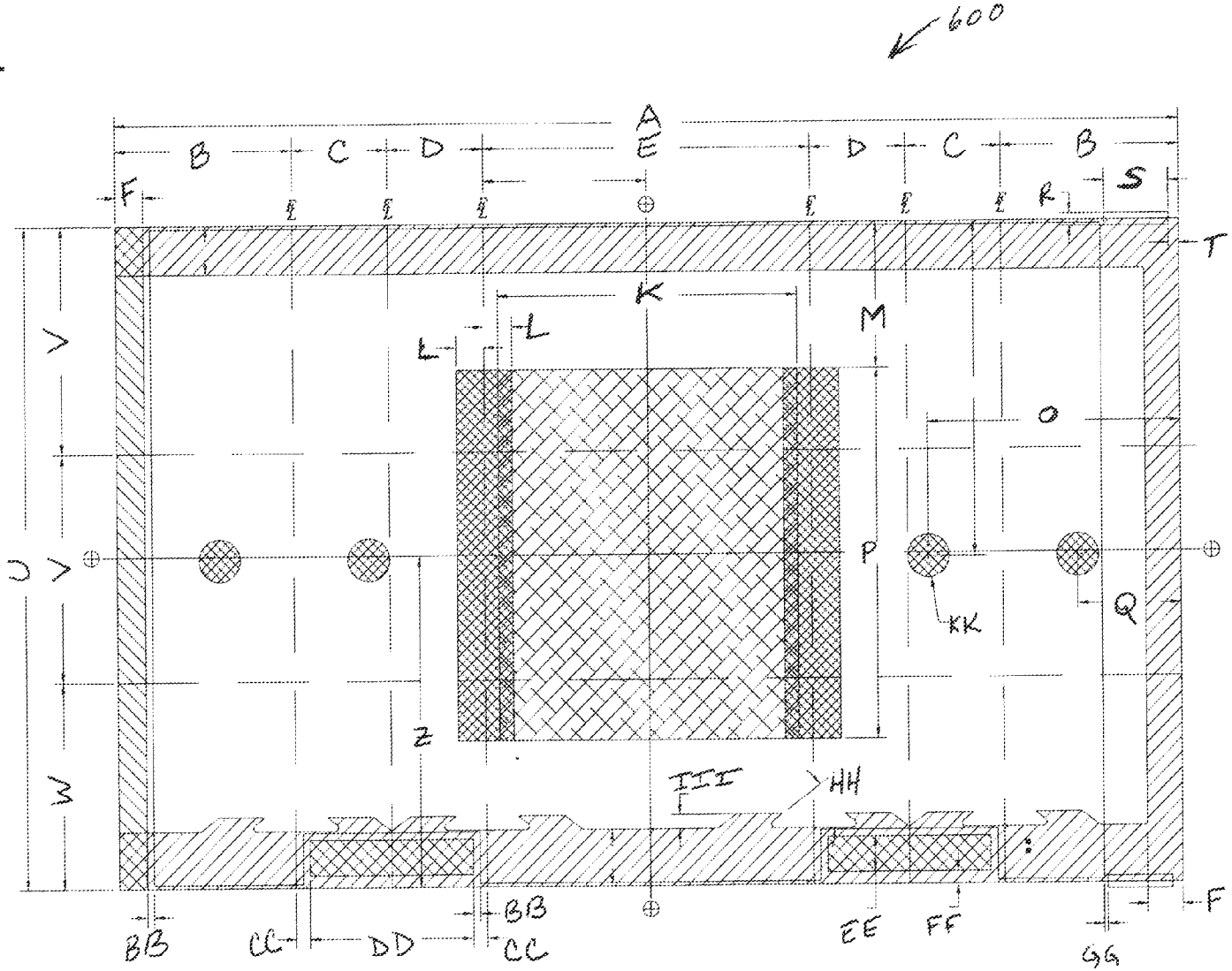
FIG. 14 is a view analogous to FIG. 13, with letters indicating example dimensions found in this text.

Dimensions would be generally analogous to those described above in connection with FIG. 9, except as provided below. Attention is now directed to FIG. 14 which shows bag blank 600 with letters indicating example dimensions. Letters analogous to those used in previous FIGS. 5, 7, 10 and 11 show the same example dimensions. Other dimensions can be derived from FIG. 14, which is to scale. The new dimension for the embodiment of FIGS. 13 and 14 is (III): 0.25 inch (6.35 mm). For blank 200 of FIGS. 6 and 9, regions 210-217 have dimension (II) of 0.5 inch (12.7 mm).

V. A Preferred Exemplary Lamination Pattern

Referring to FIGS. 15 and 16, an example of a preferred lamination pattern, for application between plies 46, 47, FIG. 4, is depicted. The lamination adhesive is usually applied to one of ply 46, 47 after which the two plies are joined together.

In FIG. 15, roll stock material 1000 is illustrated; roll stock 1000 is sufficiently wide to provide two package blanks, such as blank 200 of FIG. 3. Sealant regions 1084, 1084' correspond to sealant region 84 (FIG. 3), sealant regions 1085, 1085' correspond to sealant region 85, and sealant regions 1063, 1063' generally correspond to the area between fold lines 66, 67 (FIG. 3). Regions 1063, 1063' have a width generally the same as region 63. Sealant regions 1186, 1186' generally correspond to region 186.

Sealant regions 1063, 1063', 1084, 1084', 1085, 1085' are regions of continuous adhesive. That is, there is a generally continuous and contiguous layer of adhesive thereon. Sealant regions 1186, 1186' are regions having patterned, non-continuous adhesive. A preferred non-continuous, yet contiguous, pattern for regions 1186, 1186' is illustrated in FIG. 16.

Various dimensions are provided on FIGS. 15 and 16: (MM) 38.25 inch (97.15 cm); (A) 19.125 inch (48.58 cm); (F) 1.0 inch (2.54 cm); (2F) 2.0 inches (5.08 cm); (NN) 5.56 inches (14.13 cm); (OO) 6 inches (15.24 cm); (N1) 0.0625 inch (1.59 mm); (N2) 0.43 inch (11.11 mm).

VI. Optional Variations

A. Non-Fluorocarbon Treated Paper

Although alternatives are possible, the arrangements described herein can be formed from a bag arrangement made from two plies of non-fluorocarbon treated paper, in accord with U.S. Provisional Application 60/552,560, filed Mar. 12, 2004 and U.S. Provisional Application 60/574,703 filed May 25, 2004.

Typically when non-fluorocarbon treated papers are used for the two-plies 46, 47, the inside ply is made from a paper having a porosity (Gurley-sec) of no more than 300,000, preferably no more than 600,000 and more preferably 950,000 or less. (Higher Gurley-sec figures indicate lower porosity.) Typically, the ply would have a basis weight of 20-30 lbs/ream (3,000 sq. ft.) and preferably a basis weight of not greater than 25 lbs/ream. Typically each sheet has a thickness (caliper) of 1.75-2.0 mils (0.044-0.05 mm), typically no more than 1.9 mils (0.048 mm), for example 1.8-1.9 mils (0.046-0.048 mm).

The sheet used for the outer ply typically and preferably has a basis weight and caliper within the same ranges as stated above. It would preferably be a highly refined paper material having a porosity (Gurley-sec) of no more than 30,000, preferably no more than 35,000 and typically and most preferably 40,000 or less.

An example material utilizable for the inner ply is Wausau grade 238-9577. Papers useable for the outer ply include Wausau grade 238-9696 and Wausau grade 238-9646, each available from Reinlander Paper Company, Inc. of Reinlander, Wis., a Wausau-Mosanee Company.

B. Low Trans and No Trans Oils

Although alternatives are possible, the arrangements described herein generally include an oil/fat material contained within the bag as part of the microwave popcorn charge. In an example embodiment, the oil/fat material is as described in U.S. provisional application 60/583,762, filed Jun. 29, 2004 and U.S. provisional application 60/583,629, filed Jul. 8, 2004. The oil/fat material described in these applications can be referred to as "low trans fat" or "low trans" oil/fat materials. "No trans fat", "no trans", "zero trans" oil/fat materials are also described.

The oil/fat material described in the referenced applications, which can be used in arrangements according to the present disclosure, generally uses an oil/fat material that has a Mettler drop point of at least 90° F. and no greater than about 130° F., with the oil/fat material including a first oil/fat component comprising at least 90 wt-% of an interesterified blend of: (i) 5-50 wt-% of the mixture that undergoes interesterification of a first stearine component; and, (ii) an oil component having a saturated fat content of no greater than 50% and a Mettler drop point of no greater than 110° F. Within the microwave popcorn composition, the first oil/fat component is preferably present at a level of: (i) at least 32 wt-% of the oil/fat material; and, (ii) at least 3 wt-% of the unpopped popcorn kernels.

As stated above, the oil/fat material has a Mettler drop point of at least 90° F. and no greater than about 130° F. The Mettler drop point can be at least 110° F., and is preferably at least 115° F. An example drop point range is about 120-135° F.

Typically and preferably the first oil/fat component comprises at least 80 wt-% of the oil/fat material and is present in a level of at least 8 wt-% of the unpopped popcorn kernels. Even more preferably, the first oil/fat component comprises: at least 99 wt-% of the oil/fat material and is present at a level of at least 20 wt-% of the unpopped popcorn kernels.

The oil component used in the interesterified blend is typically soybean oil, canola oil, sunflower oil, corn oil, rapeseed oil, cottonseed oil, mid-oleic sunflower oil, safflower oil, partially hydrogenated oils of these oils, or mixtures thereof. The stearine component used in the interesterified blend is preferably selected from the group consisting essentially of cottonseed stearine, soybean stearine, and mixtures thereof.

In some instances the first oil/fat component comprises a mixture of the interesterified blend and a second stearine component. When this is done, typically the mixture contains at least 2 wt-% of the second stearine component. The second stearine component is preferably selected from cottonseed stearine, soybean stearine, corn stearine, palm stearine, and mixtures thereof. The second stearine component is selected independently of the first stearine component.

Palm oil may be suitable as a "zero trans" or "no trans" oil, with the embodiments described. Alternate low trans oil, typically having a Mettler drop point of no greater than 130° F. can also be used.

Within U.S. provisional application 60/583,762 and U.S. provisional application 60/583,629, techniques for preparation of such oils and advantages from the use are described.

VII. Some General Observations

In accord with the above teachings, a general understanding of package improvements according to the present disclosure will now be presented. In general, in a microwave popcorn arrangement comprising a folded bag having a bag interior and including a first and second opposite face panels joined by first and second opposite, inwardly directed, side gussets (in which the bag is folded to define a portion of an interior with side edges defined at junctures between the first face panel and the first and second opposite inwardly directed gussets), certain particular preferred seal arrangements and/or surface treatments are provided to manage oil/fat location or flow, in a preferential manner.

When the arrangement is used, a popcorn charge is positioned on an inside surface or against an inside surface of the first face panel, at a location preferably associated with a microwave interactive construction.

An advantageous form is presented, in which the folded bag is a two-ply bag blank, however others can be used.

In addition, an advantageous arrangement is provided in which a microwave interactive construction is positioned in association with a bag, and when the bag blank is two-ply blank, between the two plies. The microwave interactive construction, e.g., a susceptor, is provided in thermoconductive contact with a popcorn charge retention surface, i.e., a portion of the inside of the bag against which the microwave popcorn charge is placed.

For typical arrangements in which gusset fold insulating seals are used, each of the first and second gusset fold insulating seals should be at least about 4 inches (10.2 cm) long, typically at least about 5 inches (12.7 cm) long, and in the example shown as FIG. 3, about 6.5 inches (16.51 cm) long. The width of the seals will in part be dependent upon the width of the jaws that are used or applied to provide for the heat and pressure, to cause the seals. Herein in general, the width of the seal should be distinguished from the width of the sealant field from which it is formed. A typical insulating seal should be at least about 0.1 inches (0.25 cm) wide, typically and preferably at least 0.2 inches wide (0.5 cm), for example about 0.3-0.6 inch (0.8 cm-1.5 cm) wide. Of course insulating seals of varying width can be used. Preferably the insulating seals, if used, are continuous along their length.

For the embodiment shown in FIG. 3, first and second gusset fold insulating seals are positioned to abut the associated gusset folds. The seals could be spaced in part or in total from the fold. Preferably the closest border of the gusset fold insulating seal to the gusset folds is not spaced from the associated gusset fold by more than about 0.5 inch (1.3 cm), preferably no more than about 0.275 inch (0.7 cm). Most preferably the gusset fold insulating seal does abut the associated fold.

It is noted that a simple tack seal between a gusset and a panel, as generated in FIG. 3 by fields 129, 130 and 133, 134, is not sized and positioned to operate as an insulating seal with respect to the gusset folds (folds 70 and 71 respectively) in the gussets in which they are formed. They are generally too small, and positioned too far from the associated folds to have any significant insulating effect.

As to the transverse seal, typically it is at least about 4.5 inches (11.4 cm) long, preferably at least 5 inches (12.7 cm) long, in the example 5.625 inches (14.3 cm) long. Preferably its width is at least about 0.1 inch (0.25 cm) wide, preferably at least 0.2 inch (0.5 cm) wide, for example 0.3-0.6 inch (0.8-1.5 cm) wide.

Other arrangements, although not described specifically herein, fall within the general scope of this disclosure and of the following claims.

What is claimed is:

1. A microwave popcorn bag, comprising:

an expandable section defined by a first side crease and a second side crease;

a susceptor positioned within the expandable section at a location between the first side crease and the second side crease, wherein:

the susceptor has a first edge extending between edge end portions and having a length substantially parallel to the first side crease, and the susceptor has a second edge extending between edge end portions and having a length substantially parallel to the second side crease;

a first side crease seal on the inner surface of the bag that is exposed to the interior of the bag, the first side crease seal having a length and a width, wherein:

the length of the first side crease seal is substantially parallel to the first edge of the susceptor, the length of the first side crease seal is substantially parallel to the first side crease, the length of the first side crease seal is continuous and extends substantially the length of the first edge of the susceptor, wherein the length of the first side crease seal terminates to form a discontinuity between the first side crease seal and a first end seal field that extends generally perpendicular to the first and second side creases, and the width of the first side crease seal overlaps the first side crease and the first edge of the susceptor; and a second side crease seal on the inner surface of the bag that is exposed to the interior of the bag, the second side crease seal having a length and a width, wherein:

the length of the second side crease seal is substantially parallel to the second edge of the susceptor, the length of the second side crease seal is substantially parallel to the second side crease, the length of the second side crease seal is continuous and extends substantially the length of the second edge of the susceptor, wherein the length of the second side crease seal terminates to form a discontinuity between the second side crease seal and the first end seal field, and the width of the second side crease seal overlaps the second side crease and the second edge of the susceptor.

2. The microwave popcorn bag of claim 1, wherein the microwave popcorn bag is a tri-fold microwave popcorn bag.

3. The microwave popcorn bag of claim 1, wherein the microwave popcorn bag is a bi-fold microwave popcorn bag.

4. The microwave popcorn bag of claim 1, wherein the length of the first side crease seal is a proportion of the length of the first side crease, wherein the proportion is at least one member of a group comprising: at least 20% of the length of the first side crease, at least 25% of the length of the first side crease, at least 30% of the length of the first side crease, at least 45% of the length of the first side crease, and from about 50% to about 70% of the length of the first side crease.

5. The microwave popcorn bag of claim 4, wherein the length of the second side crease seal is a proportion of the length of the second side crease, wherein the proportion is at least one member of a group comprising: at least 20% of the length of the second side crease, at least 25% of the length of the second side crease, at least 30% of the length of the second side crease, at least 45% of the length of the second side crease, and from about 50% to about 70% of the length of the second side crease.

6. The microwave popcorn bag of claim 1, further comprising a first truncated chevron seal, wherein:

the first truncated chevron seal includes a first leg that extends diagonally upward from a second end seal field toward the first side crease, the second end seal field located opposite the first end seal field and extending generally perpendicular to the first and second side creases, the first leg of the first truncated chevron seal having a length and a width, the length of the first leg terminating to form a discontinuity between the first leg and the first side crease seal, the first truncated chevron seal includes a second leg that extends diagonally upward from the second end seal field toward the first side crease, the second leg having a length and a width, the length of the second leg terminating to form a discontinuity between the second leg and second side crease seal; and the first leg and the second leg extend upwardly toward each other and terminate without forming an apex and without overlapping the first side crease.

7. The microwave popcorn bag of claim 6, further comprising a second truncated chevron seal, wherein:

the second truncated chevron seal includes a first leg that extends diagonally upward from the second end seal field toward the second side crease, the first leg of the second truncated chevron seal having a length and a width, the length of the first leg of the second truncated chevron seal terminating to form a discontinuity between the first leg of the second truncated chevron seal and the first side crease seal, the second truncated chevron seal includes a second leg that extends diagonally upward from the second end seal field toward the second side crease, the second leg of the second truncated chevron seal having a length and a width, the length of the second leg of the second truncated chevron seal terminating to form a discontinuity between the second leg of the second truncated chevron seal and the first side crease seal, and the first leg and the second leg extend upwardly toward each other and terminate without forming an apex and without overlapping the second side crease.

8. A microwave popcorn bag, comprising:

an expandable section defined by a first gusset fold and a second gusset fold;

a susceptor positioned within the expandable section at a location at least partially between the first gusset fold and the second gusset fold, wherein:

the susceptor has a first edge extending between edge end portions and having a length generally parallel to the first gusset fold, and the susceptor has a second edge extending between edge end portions and having a length generally parallel to the second gusset fold;

a first gusset fold seal on the inner surface of the bag that is exposed to the interior of the bag, the first gusset fold seal having a length, wherein:

the length of the first gusset fold seal is generally parallel to the first edge of the susceptor, wherein the length of the first gusset fold seal terminates to form a discontinuity between the first gusset fold seal and a first end seal field, and the length of the first gusset fold seal is generally parallel to the first gusset fold; and a second gusset fold on the inner surface of the bag that is exposed to the interior of the bag, the second gusset fold having a length, wherein:

the length of the second gusset fold seal is generally parallel to the second edge of the susceptor, wherein the length of the second gusset fold seal terminates to form a discontinuity between the second gusset fold seal and the first end seal field, and the length of the second gusset fold seal is generally parallel to the second gusset fold.

9. The microwave popcorn bag of claim 8, wherein the microwave popcorn bag is a tri-fold microwave popcorn bag.

10. The microwave popcorn bag of claim 8, wherein the microwave popcorn bag is a bi-fold microwave popcorn bag.

11. The microwave popcorn bag of claim 8, wherein the length of the first gusset fold seal is a proportion of the length of the first gusset fold, wherein the proportion is at least one member of a group comprising: at least 20% of the length of the first gusset fold, at least 25% of the length of the first gusset fold, at least 30% of the length of the first gusset fold, at least 45% of the length of the first gusset fold, and from about 50% to about 70% of the length of the first gusset fold.

12. The microwave popcorn bag of claim 11, wherein the length of the second gusset fold seal is a proportion of the length of the second gusset fold, wherein the proportion is at least one member of a group comprising: at least 20% of the length of the second gusset fold, at least 25% of the length of the second gusset fold, at least 30% of the length of the second gusset fold, at least 45% of the length of the second gusset fold, and from about 50% to about 70% of the length of the second gusset fold.

13. The microwave popcorn bag of claim 8, further comprising a first truncated chevron seal, wherein:

the first truncated chevron seal includes a first leg that extends diagonally upward from a second end seal field toward the first gusset fold, the second end seal field located opposite the first end seal field and extending generally perpendicular to the first and second gusset folds, the first leg of the first truncated chevron seal having a length and a width, the length of the first leg terminating to form a discontinuity between the first leg and the first gusset fold seal, the first truncated chevron seal includes a second leg that extends diagonally upward from the second end seal field toward the first gusset fold, the second leg having a length and a width, the length of the second leg terminating to form a discontinuity between the second leg and the second gusset fold seal, and the first leg and the second leg extend upwardly toward each other and terminate without forming an apex and without overlapping the first gusset fold.

14. The microwave popcorn bag of claim 13, further comprising a second truncated chevron seal, wherein:

the second truncated chevron seal includes a first leg that extends diagonally upward from the second end seal field toward the second gusset fold, the first leg of the second truncated chevron seal having a length and a width, the length of the first leg of the second truncated chevron seal terminating to form a discontinuity between the first leg of the second truncated chevron seal and the first gusset fold seal, the second truncated chevron seal includes a second leg that extends diagonally upward from the second end seal field toward the second gusset fold, the second leg of the second truncated chevron seal having a length and a width, the length of the second leg of the second truncated chevron seal terminating to form a discontinuity between the second leg of the second truncated chevron seal and the first gusset fold seal, and the first leg and the second leg extend upwardly toward each other and terminate without forming an apex and without overlapping the second gusset fold.

15. A microwave popcorn bag, comprising:

a microwave interactive region positioned within an expandable section at a location at least partially between a first gusset fold and a second gusset fold, wherein:

the microwave interactive region has a first edge extending between edge end portions and having a length generally parallel to the first gusset fold, and the microwave interactive region has a second edge extending between edge end portions and having a length generally parallel to the second gusset fold;

a first gusset fold seal on the inner surface of the bag that is exposed to the interior of the bag, the first gusset fold seal having a length and a width, wherein:

the length of the first gusset fold seal is generally parallel to the first edge of the microwave interactive region, wherein the length of the first gusset fold seal terminates to form a discontinuity between the first gusset fold seal and a first end seal field, the length of the first gusset fold seal is generally parallel to the first gusset fold, and the width of the first gusset fold seal overlaps the first gusset fold and the first edge of the microwave interactive region; and a second gusset fold seal on the inner surface of the bag that is exposed to the interior of the bag, the second gusset fold seal having a length and a width, wherein:

the length of the second gusset fold seal is generally parallel to the second edge of the microwave interactive region, wherein the length of the second gusset fold seal terminates to form a discontinuity between the second gusset fold seal and the first end seal field, the length of the second gusset fold seal is generally parallel to the second gusset fold, and the width of the second gusset fold seal overlaps the second gusset fold and the second edge of the microwave interactive region.

16. The microwave popcorn bag of claim 15, wherein the microwave popcorn bag is at least one member of a group comprising: a tri-fold microwave popcorn bag and a bi-fold microwave popcorn bag.

17. The microwave popcorn bag of claim 15, wherein the length of the first gusset fold seal is a proportion of the length of the first gusset fold, wherein the proportion is at least one member of a group comprising: at least 20% of the length of the first gusset fold, at least 25% of the length of the first gusset fold, at least 30% of the length of the first gusset fold, at least 45% of the length of the first gusset fold, and from about 50% to about 70% of the length of the first gusset fold.

18. The microwave popcorn bag of claim 17, wherein the length of the second gusset fold seal is a proportion of the length of the second gusset fold, wherein the proportion is at least one member of a group comprising: at least 20% of the length of the second gusset fold, at least 25% of the length of the second gusset fold, at least 30% of the length of the second gusset fold, at least 45% of the length of the second gusset fold, and from about 50% to about 70% of the length of the second gusset fold.

19. The microwave popcorn bag of claim 15, further comprising a first truncated chevron seal, wherein:

the first truncated chevron seal includes a first leg that extends diagonally upward from a second end seal field toward the first gusset fold, the second end seal field located opposite the first end seal field and extending generally perpendicular to the first and second gusset folds, the first leg of the first truncated chevron seal having a length and a width, the length of the first leg terminating to form a discontinuity between the first leg and the first gusset fold seal, the first truncated chevron seal includes a second leg that extends diagonally upward from the second end seal field toward the first gusset fold, the second leg having a length and a width, the length of the second leg terminating to form a discontinuity between the second leg and the second gusset fold seal, and the first leg and the second leg extend upwardly toward each other and terminate without forming an apex and without overlapping the first gusset fold.

20. The microwave popcorn bag of claim 19, further comprising a second truncated chevron seal, wherein:

the second truncated chevron seal includes a first leg that extends diagonally upward from the second end seal field toward the second gusset fold, the first leg of the second truncated chevron seal having a length and a width, the length of the first leg of the second truncated chevron seal terminating to form a discontinuity between the first leg of the second truncated chevron seal and the first gusset fold seal, the second truncated chevron seal includes a second leg that extends diagonally upward from the second end seal field toward the second gusset fold, the second leg of the second truncated chevron seal having a length and a width, the length of the second leg of the second truncated chevron seal terminating to form a discontinuity between the second leg of the second truncated chevron seal and the first gusset fold seal, and the first leg and the second leg extend upwardly toward each other and terminate without forming an apex and without overlapping the second gusset fold.

* * * * *